US005199057A

United States Patent [19]

Tamura et al.

[11] Patent Number: 5,199,057

[45] Date of Patent: Mar. 30, 1993

[54] IMAGE FORMATION-TYPE SOFT X-RAY MICROSCOPIC APPARATUS

[75] Inventors: Yuichi Tamura; Hiroshi Nagata, both of Tokyo; Katsumi Mizunoe, Yokohama, all of Japan

[73] Assignee: Nikon Corporation, Tokyo, Japan

[21] Appl. No.: 833,918

[22] Filed: Feb. 11, 1992

Related U.S. Application Data

[63] Continuation-in-part of Ser. No. 784,119, Oct. 30, 1991, abandoned, which is a continuation of Ser. No. 707,927, May 28, 1991, abandoned, which is a continuation of Ser. No. 562,326, Aug. 3, 1990, abandoned.

[30] Foreign Application Priority Data

| | | | |
|---|---|---|---|
| Aug. 9, 1989 | [JP] | Japan | 1-206563 |
| Feb. 19, 1991 | [JP] | Japan | 3-24764 |
| Feb. 21, 1991 | [JP] | Japan | 3-27403 |

[51] Int. Cl.[5] ..... G21K 7/60

[52] U.S. Cl. ..... 378/43; 378/84; 378/85

[58] Field of Search ..... 378/34, 36, 43, 84, 378/85

[56] References Cited

U.S. PATENT DOCUMENTS

| | | | |
|---|---|---|---|
| 4,870,674 | 9/1989 | Schahl et al. | 378/43 |
| 4,953,188 | 8/1990 | Siegel et al. | 378/43 |

FOREIGN PATENT DOCUMENTS

| | | | |
|---|---|---|---|
| 63-298200 | 4/1988 | Japan . | |
| 1-142604 | 3/1989 | Japan . | |
| 1172327 | 11/1969 | United Kingdom | 378/43 |

OTHER PUBLICATIONS

Underwood et al, "Layered Synthetic Microstructures; Properties and Applications in X-ray Astronomy", SPCE vol. 184 Space Optics Imaging X-ray Optics Workshop (1979), pp. 123-130.

*Primary Examiner*—David P. Porta

*Attorney, Agent, or Firm*—Shapiro and Shapiro

[57] ABSTRACT

An image formation-type soft X-ray microscopic apparatus comprises:

a pulse X-ray source for applying X-rays;

a single concave aspherical multilayer film condenser for reflecting the X-rays emitted from the pulse X-ray source so as to condense the X-rays on a sample;

a two-dimensional X-ray imaging element;

a phase zone plate objective optical system for forming a image of the sample on the two-dimensional imaging element by using the X-rays;

an image processing circuit connected to the two-dimensional X-ray imaging element; and an output circuit connected to the image processing circuit for the purpose of outputting an image of the sample.

20 Claims, 11 Drawing Sheets

$\lambda/\Delta\lambda \simeq Nc$

IMAGE FORMATION-TYPE SOFT X-RAY MICROSCOPIC APPARATUS

This is a continuation-in-part of application Ser. No. 784,119 filed Oct. 30, 1991; which is a continuation of application Ser. No. 707,927 filed May 28, 1991; which is a continuation of application Ser. No. 562,326 filed Aug. 3, 1990 (all of which are now abandoned).

BACKGROUND OF THE INVENTION

1. Field of the Invention

The present invention relates to an image formation-type soft X-ray microscopic apparatus with high resolving power which is mainly used for observing organisms.

2. Related Background Art

X-ray microscopes hitherto proposed are roughly divided into the following four types:

(1) A projection enlargement type which has no optical system and in which a sample is placed at a position near an X-ray point source in the divergent pencil of the X-rays generated from the X-ray source, and an X-ray film or a two-dimensional X-ray detector is disposed at a position behind the sample at a distance therefrom.

(2) An adhesion type which has no optical system and in which an X-ray source, which supplies a bundle of substantially parallel X-rays, is used, and a resist is caused to adhere as a sample to the X-ray source. In this case, a synchrotron radiation source (referred to as "SR" hereinafter), a plasma X-ray source or an electron beam excitation X-ray source is used as the X-ray source.

(3) A scanning type in which an X-ray beam is narrowed into a small spot by an optical system, and the beam and a sample are relatively scanned. In this case, SR is used as an X-ray source, and a Fresnel zone plate (referred to as "FZP" hereinafter), a multilayer film mirror or a total reflection mirror is used as an optical element for narrowing the X-ray beam into a small spot.

(4) An image formation type in which X-rays are condensed on a sample by using an X-ray source comprising SR, a plasma X-ray source or an electron beam excitation X-ray source and an optical element such as FZP, a multilayer film mirror or a total reflection mirror, and an image of the sample is formed on a film, a fluorescent plate or a two-dimensional X-ray detector by using the same optical element.

High-resolution observation of living organisms cannot be easily made by the above-described conventional X-ray microscopes from the technical viewpoint because the microscopes are insufficiently optimized and applies large amounts of X-rays.

Namely, although the projection enlargement type (1) is required to have a high-luminance X-ray point source, exposure for a long time is required because of its insufficient intensity, and dynamic observation is thus difficult. In addition, since the sample must be sliced in order to avoid a deterioration in resolving power caused by the influence of Fresnel diffraction, it is difficult to observe a living sample.

Since the adhesion type (2) has no high-resolution detector other than the resist, the development of the resist is necessary, and real time observation is thus difficult. In addition, since the magnification is 1, enlargement observation separately using an electron microscope or the like is required. Further, destructive observation, in which the sample is sliced, is required for avoiding a deterioration in resolving power caused by the influence of Fresnel diffraction in the same way as the projection enlargement type (1).

The scanning type (3) has the disadvantage that, since an X-ray source having good directivity is required, a large X-ray source such as SR must be used, and the size of the apparatus is significantly increased. In addition, since the scanning time, i.e., the exposure time, is long for obtaining a desired image, dynamic observation is difficult.

Since the image formation type (4) exhibits a low degree of efficiency when FZP is used, a large X-ray source such as SR must be used as a high-intensity X-ray source. In addition, the image formation type (4), which uses a mirror, has a disadvantage in that the resolving power cannot be easily improve, and the size of the optical system is increased. This type is thus insufficiently optimized.

SUMMARY OF THE INVENTION

It is an object of the present invention to provide an image formation-type small X-ray microscopic apparatus which is capable of dynamically observing a living sample with high resolving power of about 20 nm and minimum X-ray exposure, without the same being fixed and broken.

The X-ray microscopic apparatus of the present invention is basically of the above-described image formation type. As shown in FIG. 1, the X rays emitted from an X-ray source are condensed on a sample by a single concave aspherical multilayer film mirror condenser, and an enlarged sample image formed on a two-dimensional X-ray imaging element by using a phase zone plate PZP as an image formation optical system.

It is effective to use as the single concave aspherical multilayer film mirror condenser a rotary elliptical multilayer reflecting mirror which has a most simple shape and which can be easily manufactured.

A plasma X-ray source using a pulse laser is used as a pulse X-ray source, and laser beams are condensed on a target so that X-rays are generated from a small region of the target. The target is disposed at the first focal point of the rotary elliptical multilayer film reflecting mirror, and the sample is disposed at the second focal point thereof. The apparatus has a system in which the X-rays are monochromatized by the multilayer film mirror, and photon counting imaging is performed by using the X-rays of one pulse generated by excitation from the pulse laser.

Specifically, in the photon counting imaging with one pulse, if the wavelength of the X-rays is $\lambda$ and the spectral width is $\Delta\lambda$, the X-ray intensity of the pulse X-ray source is adjusted so that the maximum number $n_{man}$ of detected photons incident upon the two-dimensional X-ray imaging element is within the following range:

$$25 \leqq n_{max} < \lambda/\Delta\lambda$$

In this case, the pulse width is 1 $\mu$s or less, and the pulse X-ray source used has intensity which allows imaging with one pulse. If the number of periods $N_c$ of the layer structure of the multilayer film reflecting mirror is 50 to 400, the X-rays are monochromatized so that the value of $\lambda/\Delta\lambda$ is 50 to 400, and the X-rays emitted from the pulse layer X-ray source are condensed on the sample by the rotary elliptical multilayer film reflecting mirror. An enlarged image of the organism sample is formed by the objective optical system comprising the phase zone plate having high efficiency and high resolving power.

The wavelength range of the soft X-rays used is 2.3 to 4.4 nm for observing the interior of the organism sample having a thickness of about 10 μm, without the sample being fixed and broken. This wavelength range allows the protein and the lipid in the organism to be recognized as contrast differences and the sample having a thickness substantially the same as the cell thickness to transmit the X-rays.

In order to observe a living sample, the apparatus is configured from the following viewpoints:

(a) Since the path of the X-rays is under vacuum, the sample is observed in a state wherein it is received in a container which contains water and has a thickness of about 10 μm.

(b) In order to observe a moving organism, the exposure time is several μ seconds, and a pulse X-ray source and an image formation type of optical system are employed.

(c) In order to observe a sample with producing minimum radiation damage, a phase ZP, which can maintain high resolving power of about 20 to 50 nm and high efficiency, is used as the objective optical system, and the X-rays are monochromatized by using a condenser optical system comprising a concave reflecting mirror which is a multilayer film mirror. This permits the photon counting imaging.

(d) A two dimensional X-ray imaging element is used for real time observation, and the sample is observed by an optical microscope, which generally produces little damage to the sample, and, if required, the sample is observed by an X-ray microscope.

Since X rays significantly damage organisms and easily exceeds the lethal dose, it is necessary to design the X-ray microscope so that a required image can be obtained with the minimum dose. The present invention configured as described above therefore employs an imaging method which uses a photon counting method. In order to dynamically observe an organism by using this photon counting imaging method with producing the minimum damage, the minimum X-ray dose, the detection limit contrast, the detection limit protein thickness, the gradation of the X-ray image formed, the dosage (the absorbed X-ray dose per unit mass), the pulse width, and the spectral width are optimized in view of the following matter:

(i) Detection Limit and Dose Amount of Photon Counting Imaging

FIG. 2 is a drawing which shows a state of two-dimensional photon counting. In the drawing, the surface of the sample is divided into small regions formed by the resolving power δ and the focal depth $2D_f$, each of the regions corresponding to one pixel of the imaging element. An image is formed by differences between the numbers of the photons passing through the respective pixels. The number of the photons incident on each of the pixels is $n_0$, and the numbers of the photons passing through the pixels are various values depending upon the transmittance.

It is assumed that the detection of the X-ray photons in the adjacent pixels defined by the resolving power is an independent probability phenomenon and that the X-ray photons obey a Poisson distribution. (The influence of MTF, flare and ghost in the optical system is excluded.) It is also assumed that contrast is mainly formed by differences in absorption, and that the X-rays, which are lost to the outside of the imaging optical system by diffraction scattering, are negligible. (A dark field illumination method utilizing only diffraction scattering X-rays for forming an image is excluded.)

If the average of the difference in number of the photons of the adjacent pixels is greater than the dispersion to some extent, it is possible to detect an image. If the number of the photons applied is $n_0$ [photon number/pixel], therefore, the following equation is established between the average value E and the dispersion of the photons detected in pixels $p_1$ and $p_2$ and the detection limit SN ratio $(S/N)_d$.

$$(S/N)_d^2 \leqq \frac{\{E(P_1 - P_2)\}}{V(P_1 - P_2)} \cdot n_0 = \frac{\{E(P_1) - E(P_2)\}}{V(P_1) + V(P_2)} \cdot n_0 \quad (1)$$

If the transmittance is T, the average is the following:

$$E(p_1) = T_1$$

$$E(P_2) = T_2,$$

and the dispersion in a Poisson distribution is the following:

$$V(P_1) = T_1$$

$$V(P_2) = T_2$$

Since the number $n_1$ of the X-ray photons detected is $n_1 = T \cdot n_0$, as shown in FIG. 2, $n_1$ and $n_2$ are the following:

$$n_1 = T_1 \cdot n_0$$

$$n_2 = T_2 \cdot n_0$$

The contrast C is defined by the following equation:

$$C = \frac{|n_1 - n_2|}{n_1 + n_2} = \frac{|T_1 - T_2|}{T_1 + T_2} \quad (2)$$

From the equations (1) and (2), the following equation is obtained:

$$C^2(n_1 + n_2) \geqq (S/N)_d^2$$

However, when the detection limit contrast $C_d << 1$, the maximum number of the photons detected is expressed by the following equation:

$$n_{max} \simeq (n_1 + n_2)/2$$

The detection limit contrast $C_d$ is therefore expressed by the following equation:

$$C_d \simeq (S/N)_d / \sqrt{2n_{max}} \quad (3)$$

Although the gradation from zero to the maximum photon number is generally obtained, the reproduced gradation number $d_r$, which allows the formation of an image with reliability, is the following:

$$d_r \simeq 1/C_d \simeq (\sqrt{2n_{max}})/(S/N)d \quad (4)$$

The SN ratio at the detection limit of X-ray photons depends upon the detection method used, the type of the detector used and the like. If it is assumed that an image can be expressed with gradation by using as significant information the photon number n, which is divided by $n \pm \Delta n/2$ (wherein $\Delta n = 2\sqrt{n}(\pm\sigma$: standard deviation)), the photon number at the discrimination limit is expressed by the following equation:

$$n_1 = n_{max}$$

$$n_2 = (\sqrt{n_{max}} - 1)^2$$

When $n_{max} >> \sqrt{n_{max}} >> 1$, the SN ratio at the detection limit of the X-ray photons is expressed by the following equation:

$$(S/N)_d \simeq \sqrt{2} \quad (5)$$

If the photon number is considered as significant information for each $\Delta n = 4\sqrt{n}(+2\sigma)$, the following equations are obtained:

$$n_1 = n_{max}$$

$$n_2 = (\sqrt{n_{max}} - 2)^2$$

When $n_{max} >> \sqrt{n_{max}} >> 1$, the SN ratio at the detection limit of the X-ray photons is expressed by the following equation:

$$(S/N)_d \simeq 2\sqrt{2}$$

If $\Delta n = 6\sqrt{n}(+3\sigma)$, the following equations are obtained:

$$n_1 = n_{max}$$

$$n_2 = (\sqrt{n_{max}} - 3)^2$$

and $$(S/N)_d \simeq 3\sqrt{2}$$

Typical photon numbers for gradation are n=0, 1, 4, 9, . . . in a case of $(S/N)_d \simeq \sqrt{2}$, n=0, 4, 16, 36, . . . in a case of $(S/N)_d \simeq 2\sqrt{2}$ and n=0, 9, 36, 81, . . . in a case of $(S/N)_d \simeq 3\sqrt{2}$.

If the thickness of the sample is t, the thickness of protein is $t_p$, and the linear absorption coefficients of water W and protein P are $A_w$ and $A_p$, as shown in FIG. 3, the X-ray transmittance of water $T_W$ is expressed by the following equation:

$$T_W = \exp(-A_W \cdot t) \quad (6)$$

The X-ray transmittance $T_s$ of the sample is thus expressed by the following equation:

$$T_S = T_W \cdot \exp\{-(A_P - A_W) \cdot T_p\} \quad (7)$$

Since $A_P > A_W$ within the wavelength region (2.3 to 4.4 nm) of the water window, the maximum transmittance $T_{smax}$ of the sample is expressed by the following equation:

$$T_{smax} = T_W$$

The photon number at the maximum transmittance is the maximum number $n_{max}$ of the photons detected.

From the equation (2) and the equations, $T_1 = T_W$ and $T_2 = T_S$, the thickness $t_{pd}$ of the protein P at the detection limit within the focal depth is expressed by the following equation:

$$t_{pd} = \frac{\ln(1 + C_d) - \ln(1 - C_d)}{A_P - A_W} \simeq \frac{2C_d}{A_P - A_W} \quad (8)$$

The damage to the organism produced by X-ray irradiation is determined by the dose amount. (The dose amount is the X-ray absorbed dose per unit mass.)

If the average transmittance $T_{sm}$ of the sample is $\int T_s dS / \int dS$, the density is $\rho$, the resolving power of the microscope is $\delta$, the transmittance of the window of the sample container is $T_c$, and the objective efficiency is $\eta_0$, the average absorption factor is $(1 - T_{sm})$ and the irradiated photon number is the following:

$$n_0 = n_{max}/(T_w \cdot T_c \cdot \eta_0)$$

From the photon energy $h\gamma$ and the mass $\rho \cdot \delta^2 \cdot t$, the dosage $D_m(\delta)$ is expressed by the following equation:

$$D_m(\delta) = \frac{(1 - T_{sm}) \cdot n_{max} \cdot h\nu}{(T_w \cdot T_c \cdot \eta_0)(\rho \cdot \delta^2 \cdot t)} \quad (9)$$

According to the above-described equations, if the maximum number $n_{max}$ of the photons detected per pixel is known, the detection limit contrast $C_d$ and the reproduced gradation number $d_r$ are determined. If the coefficient of linear absorption $A_p$, $A_w$ are determined from the wavelength of X-rays, the thickness $t_{pd}$ of protein at the detection limit is determined. Further, from the average transmittance $T_{sm}$ of the sample, the transmittance $T_c$ of the window of the sample container, the transmittance $T_w$ of water, the efficiency $\eta_o$ of an object, the density $\rho$ of the sample, the thickness t of the sample and the resolving power $\delta$ of the object, the dosage $D_m(\delta)$ is determined in accordance with the equation (9).

Namely, in the photon counting imaging method of the present invention, if the maximum number $n_{max}$ of the photons detected is known, main performance, i.e., the detection limit (contrast and gradation) and the dosage are determined.

(ii) X-Ray Microscopic Imaging with Minimum Exposure

In the present invention, on the basis of the above-described results of principal analysis, the minimum X-ray exposure optimum for the photon counting imaging method is determined in accordance with the following method:

It is suitable for practical use in view of the examples described below that the maximum number of the photons detected is within the following range:

$$25 \leqq n_{max} < 200$$

In accordance with this, the minimum exposure is set so that the maximum number of the photons detected per pixel is within the above range.

The above-described maximum number of the photons detected is determined on the basis of the investigation below. The prerequisites are the following:

(1) The wavelength used is about 2.5 nm within the wavelength range (2.3 to 4.4 nm) of the water window which exhibits good transmittance of water and which permits the contrast of an organism to be easily obtained.

(2) The linear absorption coefficients of water and protein at the wavelength are the following:

$$A_w=0.13/\mu m$$

$$A_p=1.5/\mu m$$

(3) The thickness t of the sample is 10 μm, which allows the observation of one cell, in consideration of the balance between the transmittance of water and the thickness of the cell.

(4) The average transmittance $T_{sm}$ is determined on the assumption that the average thickness of cell protein is expressed by the following equation:

$$T_{pm}=0.15\cdot t$$

(5) The density ρ of the sample is about 1 g/cm³.

(6) The transmittance of the window of the sample container is $T_c=0.63$, and the efficiency of the object is $\eta_o=0.3$. These values are described in detail below.

If the maximum photon number $n_{max}$ is determined on the above-described assumption, the following results are obtained:

(a) In a case of $n_{max}=100$ (A) Detection limit contrast $C_d \simeq 0.1$

Reproduced gradation number $d_r \simeq 10$ gradations (B) Detection limit protein thickness $t_{pd} \simeq 150$ nm (C) Dosage $D_m$ (20 nm) $\simeq 4 \times 10^4$ J/kg $D_m$ (50 nm) $\simeq 6 \times 10^3$ J/Kg In this case, when the resolving power δ is 20 nm, the dosage exceeds the lethal dose ($\simeq 1\times 10^4$ J/Kg).

(b) When $n_{max}$ is 200 or more, although it is possible to observe a sample with lower contrast than that in the case (a), there are the following problems;

(A) The dosage is increased and exceeds the lethal dose of cells.

(B) Since the X-rays must be further monochromatized for maintaining the precision of photon detection, a spectral element other than the multilayer film mirror and the like is required (described below).

(C) Since the coefficient of utilization of the X-ray source is decreased owing to a decrease in the spectral width, a large strong X-ray source is required.

(c) When $n_{max}$ is 25 or less, even if the resolving power is 20 nm, although the dosage is reduced to a level below the lethal dose, the detection contrast $C_d$ is 0.2 or more, the reproduced gradation number $d_r$ is 5 or less, and the limit protein thickness is 300 nm or more. The restrictions on the image quality and the sample detection are thus increased, resulting in a problem in practical use.

(d) Evaluation of performance and sample treatment

A) When the thickness $t_p$ of protein is smaller than the detection limit thickness $t_{pd}$, as in (B) of the case (a), since the contrast $C_d$ of the organism sample can be increased to a level higher than about 0.1 by vital staining (VS) of the organism with gold having a thickness of $t_{gd}=8.4$ nm, the organism can be easily observed. The thickness $t_{gd}$ of gold used for vital staining VS is determined by substituting the linear absorption coefficient $A_g=24/\mu m$ [$\lambda=2.5$ nm] into the equation (8) in place of $A_p$.

B) In this way, vital staining is necessary for observation of a low-contrast thin sample such as intracellular minute organs, virus and the like. The X-ray exposure can be decreased by vital staining of a specific part so as to significantly improve the contrast of a sample. For example, although the maximum photon number $n_{max}$ of 100 is required for observing a sample having contrast C of 0.1, the contrast C is improved to 0.2 by vital staining of the sample with gold having a thickness $t_{gd}$ of 8.4 nm. It is therefore found from the equation (3) that the stained sample can be detected with the maximum number $n_{max}$ of the photons detected of 25. Namely, the exposure is decreased to ¼, and the dosage is thus decreased to ¼.

C) Although the dosage exceeds the lethal dose of $1\times 10^4$ J/Kg when the resolving power δ is 20 nm, as in (C) of the case (a), in such a case, it is effective to perform treatment such as cooling of an organism sample for the purpose of decreasing damage to the sample and retarding the metabolism of the cells.

(iii) Detection limit when flare is present

When a zone plate is used as an image forming element, although the first diffracted light is used as image forming light, flare is generated by the other orders of diffracted light. The possible influence of the flare is the following:

Flare generally uniformly spreads over the surface of the image formed and is thus considered as fuziness of the diaphragm or the sample, which is caused by the optical system. The intensity of flare therefore depends upon the intensity of irradiation, the average transmittance of the sample and the size of visual field (the diameter of the real visual field). If the flare coefficient is $\eta_f$ (which can be calculated, as described below) of the optical system, the flare photon number $n_f$ and the detected photon number $n_I$ are expressed by the following equations:

$$n_f \simeq \eta_o \cdot \eta_f T_{sm} \cdot n_o \quad (10)$$

$$n_I \simeq \eta_o (T_s + \eta_f T_{sm}) n_o \quad (11)$$

From the equation (11), the number of the photons detected in each of the pixels is expressed by the following equations:

$$n_1 \simeq \eta_o (T_1 + \eta_f T_{sm}) n_o$$

$$n_2 \simeq \eta_o (T_2 + \eta_f T_{sm}) n_o$$

The maximum number of the photons detected is thus expressed by the following equation:

$$n_{max} \simeq \eta_o (T_{max} + \eta_f T_{sm}) n_o$$

When flare is present, the contrast $C_I$ of a detectable image and the contrast $C_s$ of a desired sample must be discriminated. The contrast is defined by the following equations:

$$C_I = |n_1 - n_2|/(n_1 + n_2) \quad (12)$$

$$C_s = |T_1 - T_2|/(T_1 + T_2) \quad (13)$$

From the above-described relation between $n_1$, $n_2$ and $T_1$, $T_2$, the following equation is established:

$$C_s = C_I(n_1 + n_2)/(n_1 + n_2 - 2n_f) \quad (14)$$

As described in (i), the contrast $D_I$ of the image and the detection limit SN ratio has the following relation:

$$C_I^2(n_1 + n_2) \geqq (S/N)_d^2 \quad (15)$$

From the above equations (14) and (15) and the following equation:

$$n_{max} \simeq (n_1 + n_2)/2,$$

the detection limit contrast $C_{sd}$ of the sample, the reproduced gradation number $d_{sd}$ and the detection limit protein thickness $t_{pd}$ are expressed by the following equations:

$$C_{sd} \simeq (S/N)_d/\{\sqrt{2n_{max}})\,(1 - n_f/n_{max})\} \quad (16)$$

$$d_{sd} \simeq 1/C_{sd} \simeq \{(\sqrt{2n_{max}})\,(1 - n_f/n_{max})\}/(S/N)_d \quad (17)$$

$$t_{pd} \simeq 2C_{sd}/(A_p - A_w) \quad (18)$$

Although the performance is therefore deteriorated by the presence of flare, the detection limit can be evaluated and calculated by the above equations.

(iv) Pulse Width Required for Dynamic Observation

If the resolving power is $\delta$, and the velocity is v, it is necessary that the exposure time $t_x$ required for obtaining a clear image of a moving object without having blurring or deformation has the following relation:

$$t_x \leqq \delta/(10 \cdot v) \quad (19)$$

Since the present invention aims at an X-ray microscope having resolving power $\delta$ of about 10 nm, and the maximum value $V_{max}$ of the velocity of plasma streaming an the ciliary and flagellous movements is expressed by the following equation:

$V_{max} \simeq 1$ mm/s, the exposure time $t_x$ is the following:

$$t_x \simeq 1\ \mu s$$

Since exposure for a time of as short as 1 $\mu$s cannot be easily realized by using the scanning type of apparatus, it is rational to use a image-formation microscopic system which uses a pulse X-ray source.

A system of exposure for a time of as short as 1 $\mu$s is useful for observing the thermal motion of the sample and the vibration of the apparatus, and thus permits the formation of a small vibration isolator.

(v) Maximum Number of Detected Photons and Spectral Width in Photon Counting

As described above, in order to dynamically observe a living organism, a conventional photon counting method in time series is not used, and it is necessary to count the photons over all the pixels for a moment of about 1 $\mu$s. In order to prevent error from occurring in counting of photons, since the energy difference caused by the wavelength difference must be less than the energy of one photon, the following equation is established:

$$\Delta n \cdot h \cdot \gamma > n_{max} \cdot h \cdot \Delta\gamma$$

Since the following equations are established:

$$\Delta n = 1,\ \gamma = c/\lambda \text{ and } \gamma/\Delta\gamma = \lambda/\Delta\lambda,$$

the maximum detected photon number $n_{max}$ has the following relation:

$$n_{max} < \lambda/\Delta\lambda \quad (20)$$

As described above, it is preferable that the maximum number of the detected photons is within the following range:

$$25 \leqq n_{max} < 200$$

The spectral width $\Delta\lambda$ and the number of periods $N_c$ of the multilayer film of the multilayer film mirror which defines the spectral width have the following relation:

$$\lambda/\Delta\lambda \simeq N_c \quad (21)$$

If $50 < N_c < 400$, therefore, the conditions for monochromatizing the X-rays are satisfied.

If the number of periods Nc of the multilayer film is about 400 or less, it is possible to observe a sample having a lower degree of contrast. For example, it is possible to observe a sample having contrast which is ½ of that in a case of Nc of 100. However, since the dosage of the organism is increased 4 times, the damage of the organism is increased, and the organism frequently dies after the observation. In addition, since an attempt can be made to further monochromatize the X-rays by increasing the number of periods, the restrictions on the chromatic aberration of the objective optical system are decreased, and an attempt can be thus made to improve the performance by, for example, enlarging the effective visual field. However, in combination of usual materials, the reflectivity is not improved in proportion to an increase in number of the layers. In addition, an increase in number of the layers causes a deterioration in the efficiency of utilization of X-rays and causes the need for a stronger X-ray source and an increase in size of the whole apparatus. The number of periods is thus limited to about 400, and the further monochromatization of X-rays is unsuitable for practical use from the viewpoint of a reduction in size of the X-ray source and damage to the organism.

On the other hand, when the number of periods Nc of the multilayer film is less than 50, it is possible to decrease the number of irradiated photons during photon counting and decrease the damage to the organism. However, the X-rays cannot be easily monochromatized, the chromatic aberration of the objective optical system is made remarkable, and the counting error in photon counting is increased. This creates a deterioration in detection performance and a problem in practical use because only a sample having high contrast can be observed. In addition, when the number of periods is small, it is difficult to achieve sufficient reflectivity within the X-ray region in the multilayer film mirror.

(vi) Sensitivity of Two-Dimensional X-Ray Imaging Element

A single photon can be detected with ideal highest sensitivity. Since the average number of the electron hole pairs generated, which serve as signals, is greater than the number of noise electrons in dark when the incident X-ray photon is one within the soft X-ray region, high sensitivity can be realized if the quantum efficiency and the vignetting factor are close to 100%.

In a case of a solid state image sensor, if the wavelength of the X-rays used is $\lambda=2.5$ nm, and the photodetector element is Si, the average number $n_p$ of the electron-hole pairs generated is 137, the standard deviation $\sqrt{n_p F}$ is 4, the Fano factor F is 0.12 and the number of noise electrons in dark is 50 (electrons/pixel). The number of noise electrons in dark can be reduced to about 10 (electron/pixel) by cooling.

DESCRIPTION OF THE PREFERRED EMBODIMENTS

Figure 1:
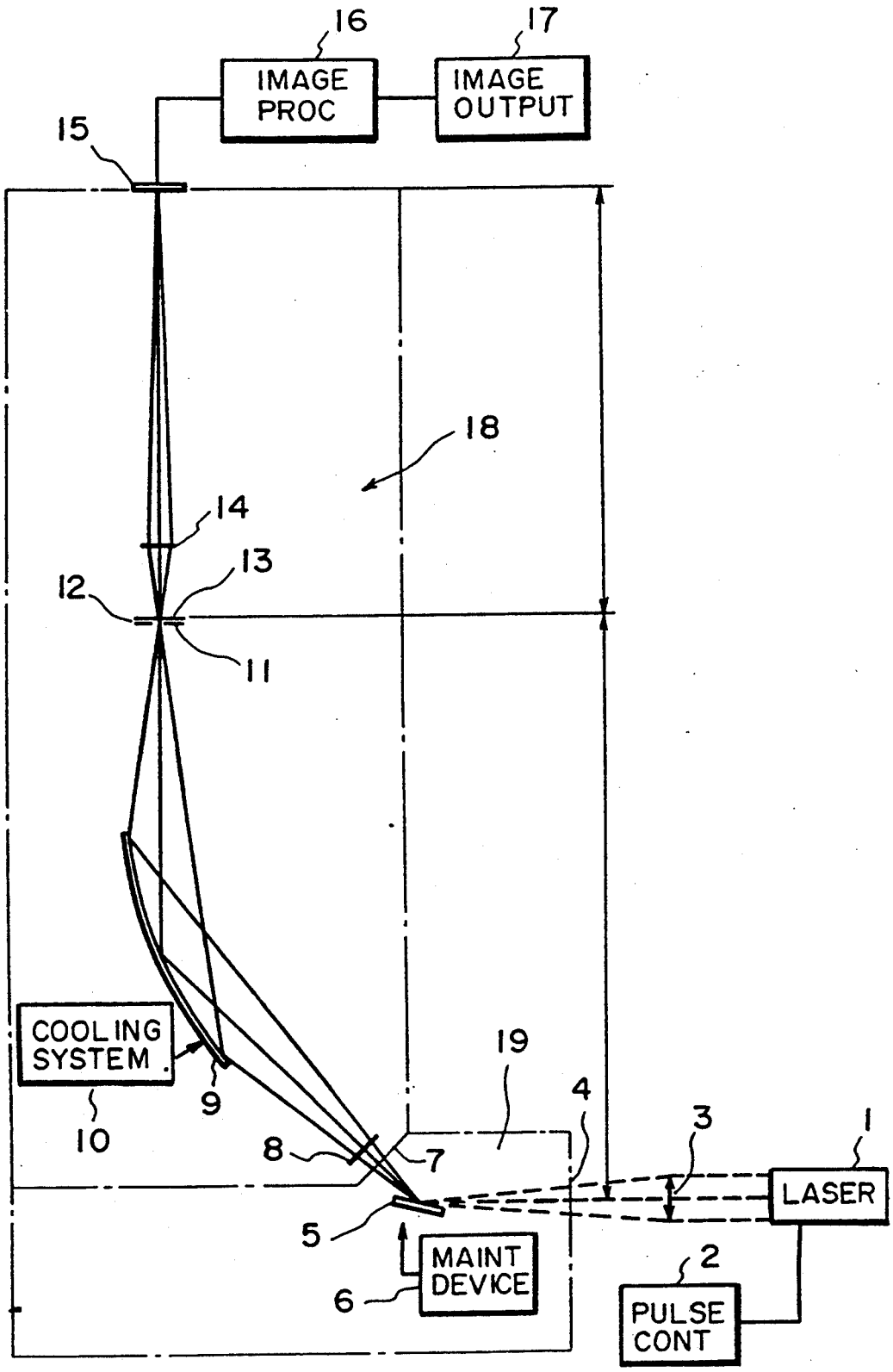
FIG. 1 is a schematic drawing of the configuration of an image formation-type soft X-ray microscope in accordance with the present invention.
Figure 2:
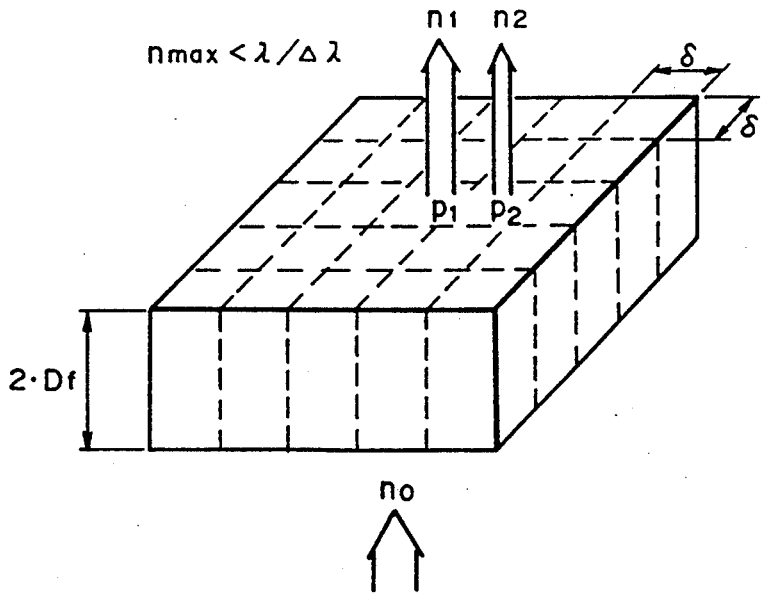
FIG. 2 is an explanatory view which shows a state of photon counting using a two-dimensional X-ray imaging element.
Figure 3:
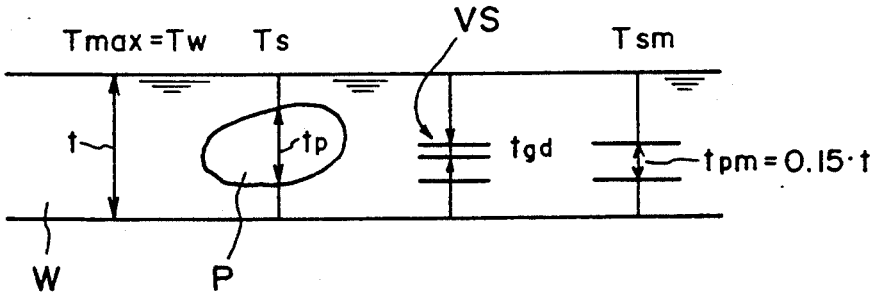
FIG. 3 is a schematic drawing of the structure of a sample which shows the thicknesses of water and protein.

The configuration of an image formation-type X-ray microscopic apparatus in accordance with the present invention is described below with reference to the embodiment shown in the drawings.

In FIG. 1, the laser beams emitted from a pulse laser 1 are condensed on a disk- or tape-shaped thin film target 5 by a condensing lens 3 through a vacuum holding window 4 so as to cause the target 5 to generate X-rays having necessary intensity and wavelength. The light emission of the pulse layer 1 is controlled by a pulse control unit 2 with a desired pulse separation (maximum, 30 Hz). The X-rays generated from the X-ray thin film target 5 are condensed on a sample 13 in a sample container 12 by a rotary elliptical multilayer film reflecting mirror 9. A sample image, which is enlarged 100 times (resolving power, 100 nm) to 500 times (resolving power 20 nm), is formed on a two-dimensional X-ray imaging element 15 by using as an image-formation optical system a phase zone plate PZP 14. For example, it is effective to use as the two-dimensional X-ray imaging element 15 a solid-state image sensor such as a back irradiation-type FT-CCD.

As shown in the drawing, in this arrangement, the X-ray thin film target 5, which is excited by the pulse laser, is disposed at the first focal point of the rotary elliptical multilayer film reflecting mirror 9, and the sample 13 is disposed at the second focal point thereof. The X-rays are monochromatized by the multilayer film so that the X-rays, which are emitted by excitation by the pulse laser, are applied to the sample, and photon counting imaging is performed by the two-dimensional X-ray imaging element 15.

In order to observe the sample 13, which is horizontally held, the X-rays for irradiation and observation are arranged in the vertical direction, and the laser beams for excitation of the X-rays are arranged in the horizontal direction. Specifically, the angle between the target 5 and the excitation laser beams is about 35°, and the angle of incident of the X-rays on the rotary elliptical multilayer film reflecting mirror 9 is about 65°. A maintenance apparatus 6 for replacing the X-ray thin film target 5 and removing scattered substances and the like, a diaphragm 7 and a shielding window for neutral particles and plasma are provided so that the X-rays are applied to the sample in a predetermined direction. The shielding window 8 also serves as a filter for adjusting the intensity $n_{max}$ of the X-rays to a value of less than 200. A water cooling apparatus is provided on the rear side of the rotary elliptical multilayer film reflecting mirror 9 serving as a condenser for the purpose of preventing temperature rising and deterioration, which are caused by the absorption of the X-rays.

A field diaphragm 11 is provided just ahead of the sample container 12, the aperture diameter thereof being changed to an appropriate value in correspondence with the observation magnification. However, even if the magnification is the same, the aperture diameter is changed to an appropriate value for the purpose of preventing the occurrence of flare and improving contrast.

The image information output from the two-dimensional X-ray imaging element 15 is processed by an image processing part 16 and then output to an image output part 17 such as a display, a printer or the like. The image processing part 16 has the function to adjusting the maximum number $n_{max}$ of the detected photons to a value of less than 200 in linkage with the intensity adjusting filter 8 provided on the X-ray source side.

Of the above-described components, the components from the rotary elliptical multilayer film reflecting mirror 9 serving as a condenser to the light-receiving surface of the two-dimensional X-ray imaging element 15 are received in a vacuum container 18 for holing them under vacuum. The pressure in the vacuum container 18 is kept at about $10^{-2}$ Pa at which absorption of the X-rays is negligible. Since the maintenance apparatus 6 or the like must be provided around the X-ray thin film target 5 because scattered substances are generated around the target 5, it is necessary to isolate the X-ray source part by another vacuum container 19.

A detailed description will now be given of the optimum specifications of the X-ray source and the optical system for realizing photon counting imaging for a moment of 1 pu'se in a level of msec or less when the maximum number $n_{max}$ of the detected photons is 100 in the above-described arrangement.

If the efficiency of utilization of the X-ray source and the efficiency of the optical system are determined, the final pulse intensity (specification of the X-ray source) of the X-ray source is determined. When a laser excitation type of X-ray source is used, the specifications of laser are determined.

Various viewpoints are in turn described below.

(vii) Diameter and Efficiency of Utilization of Nondirectional Light Source

Figure 4:
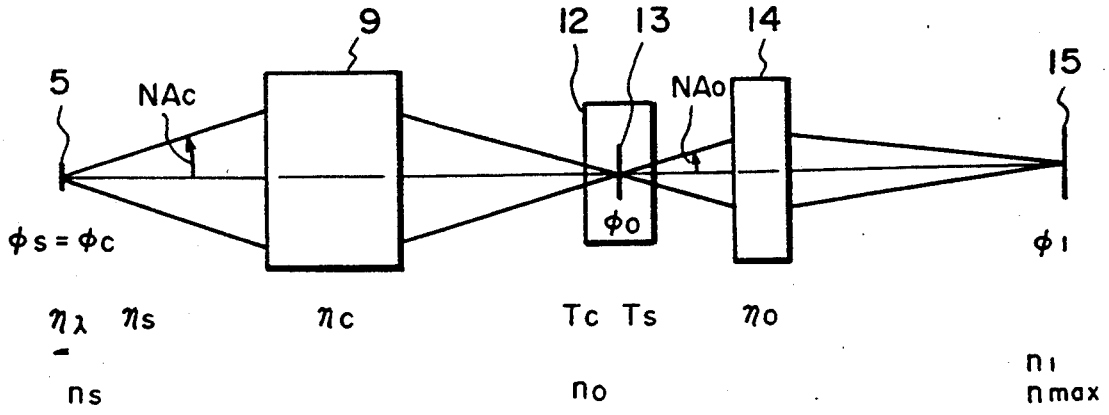
FIG. 4 is a drawing of a basic configuration provided for explaining the diameter of the light source of an image-forming X-ray microscope and the efficiency of utilization thereof in the present invention.

FIG. 4 shows the basic configuration of the image-formation X-ray microscope. In the drawing, the X-rays emitted from the target 5 are condensed on the sample 13 in the sample container 12 by the condenser 9, and an enlarged image is formed on the two-dimensional X-ray imaging element 15 through an objective optical system 14. In this embodiment, the efficiency and the transmittance are defined as follows:

$NA_c$: Numerical aperture on incident side of condenser $NA_o$: Numerical aperture on incident side of object $\phi_s$: Diameter of X-ray source $\phi_c$: Diameter of X-ray source which can be utilized by condenser $\phi_o$: Diameter of real visual field of sample (diaphragm diameter)

$\eta_w$: Spectral utilization efficiency of X-ray source $\eta_s$: Spatial utilization efficiency of X-ray source $\eta_c$: Efficiency of condenser (condensation efficiency)

$\eta_o$: Efficiency of object $T_s$: Transmittance of sample $T_c$: Transmittance of window of sample container The utilization efficiency of the X-ray source is the product of the spatial utilization efficiency and the spectral utilization efficiency. It is necessary to design the X-ray microscope by selecting the type of the X-ray source and the mode and type of the optical system so that the necessary performance is satisfied, and the efficiency is the highest.

(1) The efficiency $\eta_s$ of spatial utilization of the X-ray source by the optical system is expressed by the following equation:

$$\eta_s = \frac{\pi \cdot NA_c^2 \{\pi(\phi_c/2)^2\}}{\pi\{\pi(\phi_s/2)^2\}} = \frac{NA_c^2 \cdot \phi_c^2}{\phi_s^2} \quad (22)$$

wherein $\phi_c \leqq \phi_s$ and $NA_c \leqq 1$.

From the sine condition and the objective visual field and numerical aperture, the following equation is established:

$$NA_c \cdot \phi_c = NA_o \cdot \phi_o \quad (23)$$

The use of this equation permits the determination of the actual efficiency $\eta_s$. As described below, in the present invention, the value of the equation (23) is 1.125 μm regardless of the magnification.

As shown by the above equation, the high the utilization efficiency, the smaller the diameter of the light source as far as a condenser having a large numerical aperture can be formed. The optimum diameter of the light source and the numerical aperture of the condenser are the following:

$$\phi_s \simeq 9\ \mu m$$
$$\eta_s \simeq 1.56\%$$
$$\phi_c \simeq \phi_s$$
$$NA_c \simeq 0.125$$

Since the numerical aperture must be increased if the diameter of the light source is smaller than the above value, the condenser cannot be easily designed and manufactured, and, when a laser plasma X-ray source is used, the efficiency of X-ray generation is decreased. Conversely, if the diameter of the light source is large, the utilization efficiency is deteriorated, and the light source cannot be used for imaging with one pulse because of its shortage of intensity.

(2) From the spectral width ($\Delta\lambda/\lambda = 1/200$) obtained by the multilayer film reflecting mirror and the spectral characteristics of the X-ray source, the spectral utilization efficiency of the X-ray source is the following:

$$\eta_w \simeq 10^{-1} \cdot \Delta\lambda/\lambda \simeq 5 \times 10^{-4}$$

(viii) Efficiency of Optical System

On the other hand, when the wavelength used is 2.5 nm, the realizable efficiency of the optical system is described below.

If the multilayer film comprises nickel Ni and vanadium V, the reflection efficiency $\eta_c$ of the rotary elliptical multilayer film reflecting mirror serving as a condenser is the following:

$\eta_c \simeq 0.3$

If the sample container is composed of $Si_3N_4$, the transmittance $T_c$ of the window of the sample container is the following:

$T_c \simeq 0.63$

Since the efficiency of the object $\eta_o$ is equal to the efficiency $\eta_1$ of the first diffracted light of the phase zone plate, the object efficiency $\eta_o$ is the following:

$\eta_o \simeq 0.3$ (ix) X-Ray Pulse Intensity and Output

The pulse intensity and output of the X-ray source are calculated by using the above-described utilization efficiency of the light source, the efficiency of the optical system, the transmittance of the sample and the sensitivity of the detector (photon counting).

From (vii) and (viii), the overall efficiency $\eta$ of the optical system of the X-ray microscope is as follows:

$$\begin{aligned} \eta &= \eta_o \cdot T_c^2 \cdot \eta_c \cdot \eta_w \cdot \eta_s \\ &= 3 \times 10^{-7} \end{aligned} \quad (24)$$

If the number of the photons of the X-ray source corresponding to a single pixel of the detector is $n_s$, the number $n_I$ of the photons which reach a single pixel of the detector is expressed by the following equation:

$$n_I = T_s \cdot \eta \cdot n_s \quad (25)$$

If the maximum transmittance of the sample is $T_{smax} = T_w = 0.273$, and if the maximum number of the photons detected is $n_{max} = 100$, the necessary photon number $n_s$ for the X-ray source is the following:

$$\begin{aligned} n_s &= n_{max}/(T_w \cdot \eta) \\ &= 1 \times 10^9 \text{ [photon/pixel]} \end{aligned} \quad (26)$$

If the energy of the X-ray photons $\epsilon_p$ is $\epsilon_p = h\gamma = 7.9 \times 10^{-17}$ J [$\lambda = 2.5$ nm], and if the pixel number $N_I$ in the circumscribed circle of the imaging element, which obtained by the pixel number in accordance with the NTSC system is the following:

$N_I \simeq \pi \times (450)^2 = 6.4 \times 10^5$, the X-ray pulse intensity $P_x$ required for obtaining an X-ray image on a sheet and the X-ray output $I_x$ required for obtaining 30 images per second are the following:

$$\begin{aligned} P_x &= N_I \cdot n_s \cdot \epsilon_p \simeq 50 \text{ [mJ/image]} \\ I_x &= 1.5 \text{ W} \end{aligned} \quad (27)$$

(x) Laser Pulse Intensity and Output

It is preferable to generate the X-rays by using laser excitation plasma, as described below. If the efficiency $\eta_x$ of generation of the X-rays by using a laser is $\eta_x = 0.1$, from the equation, $P_x = \eta_x \cdot P_L$, the laser pulse intensity $P_L$ and the laser output $I_L$ are the following:

$P_L = 500$ [mJ/image]

$I_L = 15$ W

The above-described X-ray source and pulse laser can be manufactured.

(xi) Specification and Type of X-Ray Source

Although the optimum specifications of the X-ray source are determined as described above, a laser plasma X-ray source, which uses a pulser laser, is optimum as an X-ray source which conforms to the specifications. Other types of plasma X-ray sources and electron beam excitation X-ray sources cannot be brought into practical use because the utilization efficiency is deteriorated owing to the sizes of the X-ray sources, which are as large as 0.1 to 1 mm $\phi$, as described in (vii) (1).

On the basis of the above results, a nondirectional X-ray source must satisfy the following conditions:

a) Diameter of X-ray source: $\sim 10\ \mu m\phi$
b) X-ray spectrum: 2.3 nm to 4.4 nm
c) X-ray pulse width $< 1\ \mu s$
d) X-ray pulse intensity $> 50$ mJ
e) X-ray repetition frequency $\sim 30$ Hz Although a laser excitation plasma X-ray source is suitable for satisfying these conditions, it is effective that higher harmonics of a slab laser or a pulse laser such as an excimer laser is used as the laser. Specifically, a target material having a thickness of several $\mu m$ is selected, and the above-described conditions are satisfied by optimization with respect to the items (f) to (j) described below.

f) Laser/X-ray conversion efficiency $> 0.1$
g) Laser wavelength $\sim 250$ nm
h) Laser condensing diameter $\sim 10\ \mu m\phi$
i) Laser pulse width $< 1\ \mu s$
j) Laser pulse intensity $> 500$ mJ (xii) Condenser System and Optimization Thereof From the efficiency hc and the numerical aperture of the condenser and the degree of monochromatization, which are described above, the following conditions are determined:

a) In order to reduce the size of the X-ray source, it is necessary that the reflectance (efficiency) hc is about 30%.

b) In order to effectively utilize the X-ray source, it is necessary that the numerical aperture MAc is about 0.125.

c) The degree of monochromatization (spectral width) for photon counting imaging with one pulse is the following:

$\lambda/\Delta\lambda = 200$

Further, the illumination system must satisfy the following conditions (d), (e) and (f):

(d) In order to perform effective illumination by using a minimum optical element, a critical illumination method is used in which a light source has the following magnification M:

M = real visual field/diameter of X-ray source (e) In order to effectively condense X-rays and remove the irregularity of illumination, it is necessary to effectively correct aberration.

f) In order to reduce the size of the illumination system, it is preferable that the vertical distance between the X-ray source and the sample is about 200 to 800 mm.

g) Since extremely strong X-rays with intensity, which is about 2000 times that of the X-rays applied to the sample, is applied to the condenser, as described above in (vii) (2), the condenser must be cooled for protecting the optical element.

In order to satisfy the conditions, it is effective to use as the condenser a rotary elliptical multilayer film mirror having a multilayer film composed of nickel and vanadium with a number of periods $N_c$ of about 200.

The above conditions cannot be easily satisfied by any other optical elements such as a zone plate and total reflecting mirrors. For example, although the annular zone number and the numerical aperture of a zone plate must be increased, such a zone plate cannot be easily manufactured. Specifically, when the distance $L_c$ between the light source and the sample is 100 mm, $NA_c$ is 0.125 and the magnification M of the light source is 2 (resolving power, 20 nm; combination with an object with magnification of ×500), from the equations below, the annular zone number of the zone plate is 312500, the minimum line width is 6.7 nm and the zone radius is 4.17 mm. Such a zone plate cannot be easily produced by the present technique. In addition, the zone plate cannot be easily cooled because of its structure. In a case of a total reflecting mirror, since another spectral element is required for monochromatizing X-rays the spatial utilization efficiency of the light source is deteriorated owing to the shielding of the aperture portion. In a case of a spherical multilayer film mirror, since it is difficult to correct aberration by using a single surface, uniform illumination cannot be effectively made. The use of two-surface reflection for correcting aberration causes a deterioration in efficiency, which caused by low reflectance and shielding of the aperture portion. For example, in a case of a Schwarzschild type which uses two reflecting spherical surfaces, even if a multilayer film having reflectance of 30% is used, the condensing efficiency is about 5% at most if the shielding of the central portion is considered.

From the above-described viewpoints, a rotary elliptical multilayer film reflecting mirror, which permits good aberration correction and effective condensation by one reflection and which has a simplest shape, is optimum as the condenser. In addition, with respect to the processing precision of a rotary elliptical surface, the shape precision is about 200 nm and the surface roughness is about 0.2 nm, apart from the surface used in an image-formation system. Hence such a rotary elliptical surface can be easily produced. In regard to cooling of the element, the rear side of the rotary elliptical multilayer film mirror can be effectively cooled with water.

Figure 5:
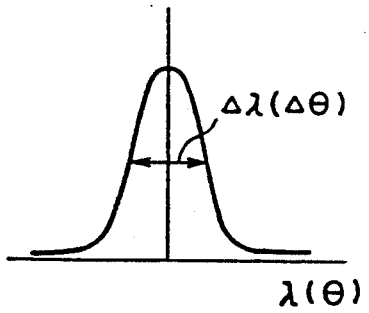
FIG. 5 is a drawing which shows the spectral characteristics of reflected X-rays in a rotary elliptical multilayer film mirror.
Figure 6:
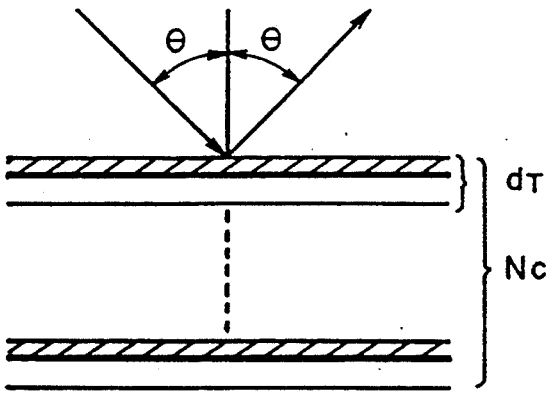
FIG. 6 is a schematic sectional view which shows the structure of the multilayer film of a rotary elliptical multilayer film mirror.

FIG. 5 shows the spectral characteristics of the reflected X-rays in such a multilayer film mirror. In FIG. 5, the wavelength λ (or reflection angle θ) is shown on the abscissa, and the X-ray intensity is shown on the ordinate. FIG. 6 is a schematic sectional view which shows the structure of the multilayer film. In the drawing, the angle of incidence of an X-ray upon the multilayer film is considered as an angle θ measured on the basis of the nominal line.

The width Δλ of the spectrum obtained by the multilayer film is determined as described below.

The coherence distance ($\lambda^2/\Delta\lambda$) and the number Nc of periods of the multilayer film and the thickness $d_T$ of one period of the multilayer film have the following relation:

$$2N_c d_T \cos\theta = \lambda^2/\Delta\lambda \tag{28}$$

From the conditions for coherence between the adjacent periods, the following Bragg's condition is established:

$$2d_T \cos\theta = \lambda \tag{29}$$

From the equations (28) and (29), the relation expressed by the above-described equation (21) is obtained.

Figure 7:
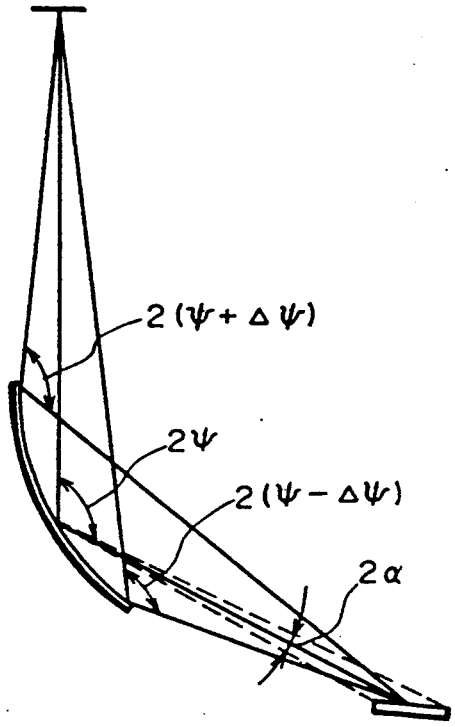
FIG. 7 is a drawing of the optical path which shows the state of a reflected light flux in a rotary elliptical multilayer film mirror.

As shown in FIG. 7, in the rotary elliptical multilayer film mirror, the incident angles of the X-rays generated from the target 5 are different in the respective reflection regions of the rotary elliptical multilayer film mirror 9, and the variation in incident angle exceeds the allowable width of reflection angle described below. In a multilayer film having the uniform structure, therefore, reflectance is significantly decreased in some region. It is therefore necessary to change the thickness ratio of in each region of the multilayer film in correspondence with the change in incident angle. However, the width α of the incident angle at the same reflection point is within an allowable width of reflection angle. Specifically, as shown in FIG. 7, the incident angle of the X-ray at the central portion of the rotary elliptical reflecting mirror 9 is Ψ, and the incident angles at both ends of the reflecting mirror 9 are respectively Ψ+ΔΨ and Ψ−ΔΨ. If an angle width, which can maintain predetermined reflectance as a multilayer film if the incident angle is changed, i.e., the allowable incident angle width, is dθ, from the equations (21) and (29), the allowable angle width for effective reflection of the multilayer film mirror and the number of period $N_c$ of the multilayer film have the following relationship:

$$\tan\theta \cdot d\theta \simeq 1/N_c \tag{30}$$

On the other hand, if the sine condition is satisfied in the illumination system, the following equation is established:

$$\Delta\Psi \simeq \{\sin^{-1}(NAc) = \sin^{-1}(NA_c/M)\}/2$$

In addition, since NAc<<1, $$\Delta\Psi \simeq NA_c(M-1)/(2\cdot M)$$

It is therefore preferable to divide the reflection region of the rotary elliptical body into bands by the number obtained by the following equation:

$$\frac{\Delta\psi}{d\theta} \simeq \frac{N_c \cdot NA_c(M-1)}{2\cdot M} \cdot \tan\theta \tag{31}$$

It is also preferable to form the multilayer film comprising regions each having an optimized thickness ratio.

For example, when θ=65° and M=2, ΔΨ/dθ≃13. It is therefore preferable that the reflection region of the multilayer film of the rotary elliptical body is divided into 26 band regions. As described above, θ=65° is an angle which is suitable for observing the sample while horizontally maintaining it.

For the condenser optical system in accordance with the present invention, a rotary elliptical multilayer film reflecting mirror such as that described above is most practical. However, an arrangement based on a combination of a concave reflecting mirror and a diffraction grating is also effective. In this case, a wavelength selecting function is achieved by the diffraction grating, while in the case of a rotary elliptical multilayer film reflecting mirror, a multilayer film is used to reflect X-rays from an X-ray source selectively in a desired wavelength range at a high efficiency. Examples of such an arrangement will be described later in (xiv) "Other Arrangements of the Condenser System."

(xiii) System and Optimization of Objective Optical System

A phase zone plate, which has high efficiency, high resolving power and high magnification and which can be formed into a small size, is used in the objective optical system. The conditions necessary for the objective optical system are the following items (a) to (d):

a) The efficiency is increased for reducing damage to the sample.

$$\eta_o \simeq 30\%$$

b) Since the resolving power of an optical microscope, which is capable of observing organisms, is 200 nm, the resolving power $\delta$ is 20 to 100 nm which is superior to the above value.

c) In order to enable the attainment of high resolving power by using the imaging element, the magnification $\beta$ is determined as a value which is obtained by dividing the pixel dimension (10 nm) of the imaging element by desired resolving power.

$$\beta = 100 \text{ to } 500 \text{ (high magnification)}$$

d) In order to reduce the overall size of the apparatus, the distance $L_o$ between the object and the image is about 400 mm or less. Each of the above conditions can be satisfied by the phase zone plate, as in the design examples below. However, it is difficult to realize an objective optical system having the same specifications by using a mirror such as a total reflecting mirror or a multilayer film reflecting mirror for the reasons described below. It is difficult to reduce the size to a level, in which the distance between the object and the image is 200 nm, by using a mirror with high magnification. It is also difficult to manufacture a mirror with high magnification because the shape accuracy is as restrict as the order of wavelength (several nm). In addition, when an objective multilayer film mirror is formed, since two surfaces having low reflectance must be used for aberration correction, the aperture is partly shielded. Thus, the efficiency is low, and the optical adjustment is difficult.

Figure 8:
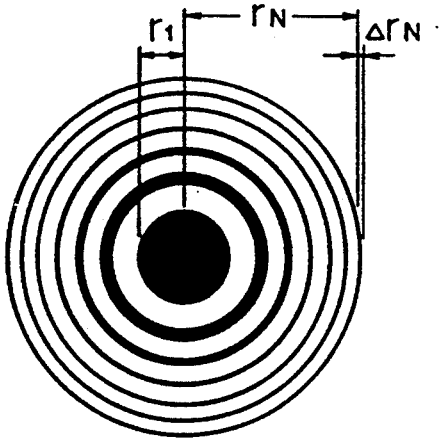
FIG. 8 is a plan view of a general zone plate.
Figure 9:
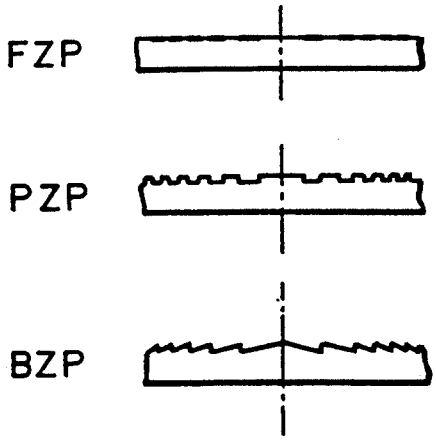
FIG. 9 is a sectional view of various zone plates.

As shown in FIG. 8, a zone plate is generally a zonal optical element and, as shown in FIG. 9, it is classified into a Fresnel zone plate FZP, a phase zone plate PZP and a saw tooth zone plate BZP according to their sectional shapes. Although BZP among these zone plates exhibits the highest efficiency, since BZP used for the X-ray region cannot be easily manufactured, PZP, which is next to BZP with respect to efficiency, is generally used. It is necessary to make an attempt to improve the efficiency of such a phase zone plate and reduce the occurrence of flare. It is also necessary to coordinate the irradiation spectral width and the chromatic aberration, secure the effective visual field diameter and keep the focal surface constant (so-called "parfocal") even if the magnification is changed.

Each of the above viewpoints is described below with reference to typical examples of design of the phase zone plate.

(1) Efficiency of Phase Zone Plate

Figure 10:
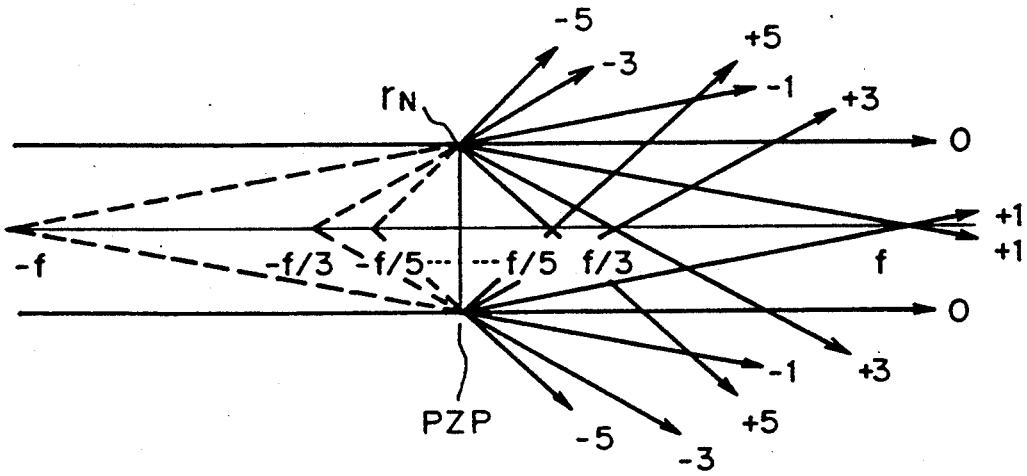
FIG. 10 is a drawing which shows diffracted light of a zone plate.

FIG. 10 is a drawing which shows the diffracted light of the zone plate. As shown in the drawing, many orders of diffracted light are present. The focal distance and diffraction efficiency of each of the orders of diffracted light of the phase zone plate, which has a negligible thickness, are generally expressed by the following equations:

$$f_m = f/m \ (m = 0, \pm 1, \pm 3, \pm 5 \ldots) \quad (32)$$
$$\eta_m = (1 + T_z^2 - 2T_z \cdot \cos\chi)/(m\pi)^2 \quad (33)$$
$$\eta_0 = (1 + T_z^2 + 2T_z \cdot \cos\chi)/4 \quad (34)$$
$$\eta_{ab} = (1 - T_z^2)/2 \quad (35)$$

wherein $f_m$: Focal distance of m-order diffracted light f: Focal distance of first diffracted light which is used for forming an image $\eta_m$: Diffraction efficiency of m-order diffracted light ($\eta_o \equiv \eta_1$)

$\eta_o$: Diffraction efficiency of zero-order diffracted light (direct light)

$\eta_{ab}$: Absorption efficiency of phase zone plate $T_z$: Amplitude transmittance of phase zone plate $\chi$: Phase difference between adjacent (dark and light) zones If the amplitude transmittance is $T_z = 1$ and the phase difference is $\chi = \pi$, the efficiency is ideally 40%. However, in fact, since the material of the zone plate absorbs light, the highest efficiency with a wavelength of 2.5 nm is about 30%. However, if the sectional shape is a step-like shape or a saw tooth-like shape, the efficiency can be further increased (for example, Japanese Patent Laid-Open No. 1-142604 by the same applicant as this application).

Such a high-efficiency zone plate is also significantly effective for reducing flare, as described below.

(2) Flare of Phase Zone Plate

Figure 11:
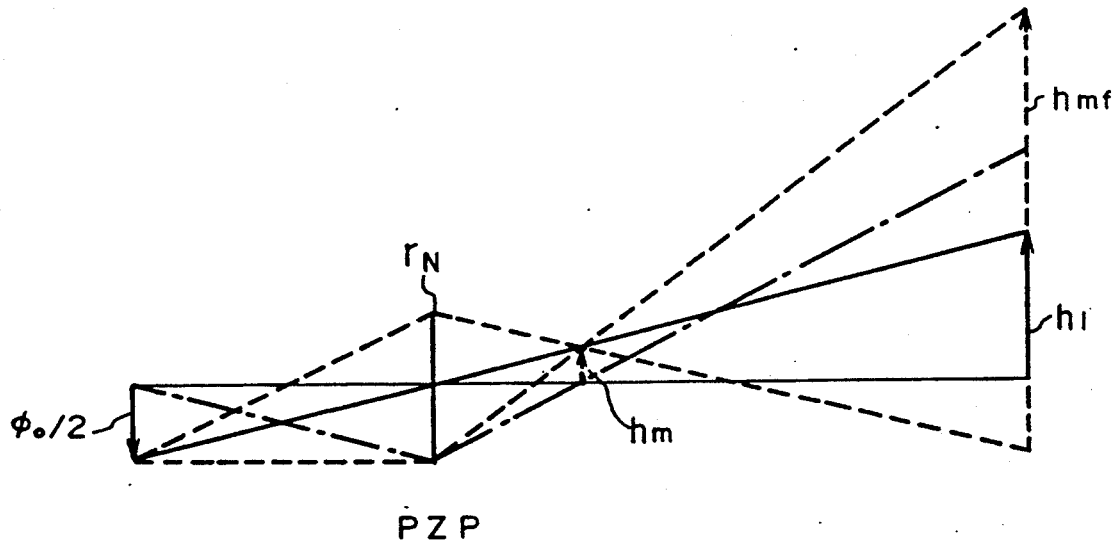
FIG. 11 is a drawing which shows a state where flare is generated by m-order diffracted light.

Although the first diffracted light having the highest diffraction efficiency is generally used for forming an image, the other orders of diffracted light are made flare and thus they must be removed. FIG. 11 is a drawing which shows the state wherein flare is generated by the m-order diffracted light. In the drawing, the solid lines show the image formed by the first diffracted light, and the broken lines show the image and flare formed by the m-order diffracted light. A small image having a height of $h_m$ is formed near the zone plate by the m-order diffracted light, and this image is effectively enlarged to a height of $h_{mf}$ to form a faded image on the surface of the image (height $h_I$) formed by the first diffracted light.

The relative intensity $\zeta m$ of the faded image formed by the m-order diffracted light on the surface of image formed by the first diffracted light is expressed by the following equation:

$$\zeta m = (h_I/h_{mf})^2$$

If the magnification by the first diffracted light of the zone plate is $\beta$, the radius of the phase zone plate (the radius of the outermost annular zone ring) is $r_N$ and the field diaphragm diameter is $\phi_o$, the following equations are established:

$$h_I=\beta\phi_o/2$$

$$h_{mf}\approx\{(m-1)r_N\pm\phi_o/2\}$$

(wherein the plus sign denotes a case where m is 1 or more, and the minus sign denotes a case where m is 1 or negative). The relative intensity $\zeta m$ is therefore expressed by the following equation:

$$\zeta m\approx 1/\{(m-1)2r_N/\phi_o\pm 1\}^2 \quad (36)$$

Since the flare coefficient $\eta_f$ of the optical system in the equation (10) is the sum of the products of the diffraction efficiency of diffracted light and the relative intensity of the geometrical faded image, the flare coefficient is the following:

$$\begin{aligned}\eta_f &= \Sigma\eta_{fm} = \Sigma\zeta_m\cdot\eta_m/\eta_I \quad (37)\\ &\approx \frac{(1+T_z^2+2T_z\cdot\cos\chi)}{(1+T_z^2-2T_z\cdot\cos\chi)\{(2r_N/\phi_o+1)2/\pi\}^2}+\\ &\quad \Sigma\frac{1}{[m\{(m-1)2r_N/\phi_o\pm 1\}]^2}\end{aligned}$$

$$(m=-1,\pm 3,\pm 5,\ldots)$$

In an optical system which uses a usual Fresnel zone plate of $T_z=0$ or an actual phase zone plate of $T_z\neq 1$, the illumination method can be designed so that the zero-order diffracted light in the first term of the above equation is cut off. Only the flare produced by the higher-order diffracted light in the second term and the subsequent terms is therefore a problem.

As seen from the equation (37), since the flare coefficient $\eta_{fm}$ of the m-order diffracted light is inversely proportional to the fourth power of the diffraction order, it is sufficient that zero-, $-1$-, $\pm 3$- and $\pm 5$-order diffracted light are considered as the main diffracted light for flare. If the field diaphragm diameter is one fifth of the zone plate diameter ($\phi o=2rN/5$), the flare is reduced to about 1/100. In the microscope of this embodiment in which the maximum number of the photons detected is about 100, the photon number of flare can be restricted to about 1 or less by diaphragming the field so as to be negligible.

From the above viewpoint, a field diaphragm (the real field is determined by the diaphragm diameter) which is determined by the diagonal length of the imaging element and a field diaphragm having a diameter of about one fifth of the zone plate diameter are prepared for each object so that a clear image without flare can be obtained as occasion demands.

This is a condition for obtaining a clear image without flare even in a state wherein flare is remarkably produced, as in a case ($T_{sm}/T_{smax}\approx 1$) where black points are slightly produced in a light field. It is unnecessary to so severely restrict the visual field in practical use. As a result of further detailed investigation, the allowable number of flare $n_f$ is 1 or less per pixel on an average, as described above. Since this is expressed by the equation, $n_f<<n_{max}$, from the equations (10) and (11), the following equation is obtained:

$$n_f\approx\eta_f(T_{sm}/T_{smax})\cdot n_{max}<1$$

Since the thickness of a usual living sample is 10 μm, and the average protein thickness is $t_{pm}=1.5$ μm, from the equation (7), the average transmittance $T_{sm}=0.035$. In addition, since $T_{smax}=T_w=0.273$, the following equation is obtained:

$$T_{sm}/T_{smax}=0.128$$

The allowable value Of the flare coefficient $\eta_f$ is the following:

$$\eta_f<1/(0.128\cdot n_{max})$$

When the maximum number $n_{max}$ of the photons detected is 100, $\eta_f<0.08$. From the equation (37), the field diaphragm diameter $\phi_o$ having the above flare coefficient is determined by the following equation:

$$\phi_o\approx 7r_N/5$$

In this way, when a usual sample is observed, the occurrence of flare can be made negligible by limiting the aperture diameter of the field diaphragm to 70% of the diameter of the zone plate.

As described above, in order to form a clear image with negligible flare, the visual field may be limited in accordance with the sample used. It is sufficient for a usual sample that the field is reduced to 70% of the diameter of the zone plate. Even if the visual field is further reduced, it just becomes narrow. The real field diameter, which is determined by the diagonal length of the imaging element, a diaphragm for ordinary samples, which has an aperture of 70% of the zone plate diameter, and a diaphragm for limit samples, which has an aperture of 20% of the zone plate diameter, are provided for practical use so that practical observation can be made by properly using them.

As disclosed in the above-described Japanese Patent Appln. Laid-Open No. 1-142604, when a high-efficiency zone plate producing no minus-order diffracted light is used, no diaphragm is inserted, but a shield of a size, which is substantially the same as the +3-order image or +5-order image, is disposed at the position of the image so that flare can be significantly reduced.

(3) Relation Between Various Quantities of Zone Plate

Equations necessary for designing a general optical system are given below. In regard to the resolving power δ and the focal depth $D_f$, if the numerical aperture is $NA_o$, and the wavelength is λ, the following equations are established:

$$\delta=\lambda/\{2(NA_o)\} \quad (38)$$

$$D_f=\pm\lambda/\{2(NA_o)^2\} \quad (39)$$

If the focal distance is f, the object-image distance is $L_o$, and the magnification is β, the following equation is established:

$$f=\beta\cdot L_o/(\beta+1)^2 \quad (40)$$

On the other hand, in the zone plate, the focal distance is the focal distance of the first diffracted light and has the following relation to the annular zone radius $r_k$ of the zone plate:

$$r_k^2\approx k\lambda f \quad (41)$$

wherein the annular zone number; $k=1, 2, 3, \ldots, N_o$ (light and dark zones are numbered 2)

If the width of the outermost annular zone as the minimum zone width of the zone plate $\Delta r_N$ is expressed by the following equation:

$$\Delta r_N = r_N - r_{N-1},$$

the various quantities of a general optical system and the various quantities of the zone plate have the following relations:

$$\delta \simeq \Delta r_N(\beta+1)/\beta \quad (42)$$
$$D_f \simeq \pm f(\beta+1)^2/(2N_o\beta^2) \quad (43)$$
$$r_N \simeq L_o \cdot NA_o/(\beta+1) \quad (44)$$
$$N_o \simeq L_o \cdot NA_o^2/(\lambda \cdot \beta) \quad (45)$$

Since the magnification $\beta$, the resolving power $\delta$ and the wavelength $\lambda$ used are determined as specifications, if $N_o$ or $L_o$ is determined in accordance with the equation (45), all the quantities of the zone plate excluding the efficiency are determined by the above equations. The factors which determine $N_o$ or $L_o$ is the above-described flare and the allowable spectral width and effective field diameter below.

(4) Coordination of Irradiation Spectral Width and Chromatic Aberration

The chromatic aberration dZ' is generally expressed by the following equation:

$$dZ' = (1+\beta)^2 df \quad (46)$$

If the chromatic aberration is smaller than the focal depth, there is no problem in practical use. Since the focal depth on the image surface is $\beta^2 D_f$, the following equation may be satisfied:

$$dZ' \leqq \beta^2 D_f \quad (47)$$

This is a condition for determining the allowable chromatic aberration.

In regard to the zone plate, from the equation (41), the following equation is established:

$$df = -f \cdot d\lambda/\lambda$$

From this equation and the equations (40), (45) and (46), the chromatic aberration of the zone plate is expressed by the following equation:

$$dZ' = \{N_o(\beta/NA_o)^2\} d\lambda \quad (48)$$

From the equation, $\Delta\lambda = 2d\lambda$, and the equations (39), (47) and (48), the following equation is established:

$$\lambda/\Delta\lambda \geqq N_o \quad (49)$$

This equation (49) is a condition for the allowable chromatic aberration of the zone plate. It is necessary that the spectral width $\Delta\lambda$ and the annular zone number $N_o$ of the zone plate satisfy the above relation.

In the configuration of this embodiment, since the spectral width is determined by the multilayer film mirror so that $\Delta/\Delta\lambda = N_c = 200$, as described above, it is necessary that $N_o \leqq 200$.

(5) Effective Field of Zone Plate

Figure 12:
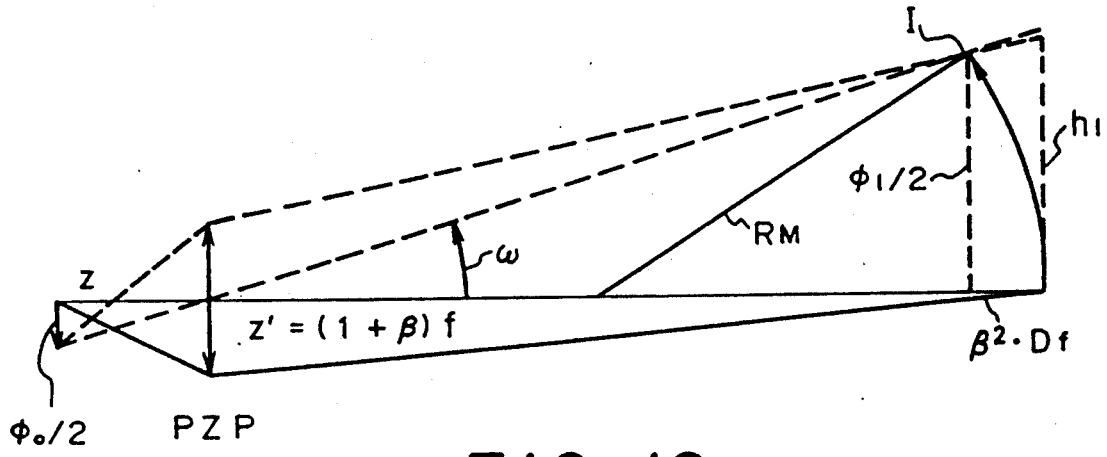
FIG. 12 is a drawing which shows a state where an image surface is curved by a zone plate.

FIG. 12 is a drawing which shows the state where an image surface is curved by the zone plate. The image formed by the zone plate is generally curved as shown by the solid line in the drawing. Since the numerical aperture $NA_o$ of the zone plate in the present invention is relatively as small as $<0.1$, the quality of the image formed can be evaluated by using the tertiary aberration coefficient of the zone plate. Since the curvature aberration coefficient is zero in accordance with the tertiary aberration coefficient of the zone plate, astigmatism and the curvature of the image are dominating factors which deteriorate the image. From the tertiary aberration coefficient, the radius RM of curvature of a meridional image surface is expressed by the following equation;

$$R_M = f/3 \quad (50)$$

The effective visual field is determined by this value and the focal depth $\beta^2 D_f$. Namely, the region which, allows the curvature of the image surface to be within the focal depth of the image surface, is the effective field.

FIG. 7 schematically shows the optical path in a relation of image formation between the zone plate and an object. An image of a sample 13 having a height of $\phi_o/2$ is enlarged to a height of $\beta\phi_o/2$ by a zone plate 14. Since a curved image surface I is within the range of the focal depth $\beta^2 D_f$ on the image surface, the image can be detected as a clear image within the height range to $\beta\phi_o/2$. This relation is expressed by the following equation:

$$(\beta\phi_o/2)^2/(2R_M) \leqq \beta^2 D_f \quad (51)$$

If the half view angle of the zone plate is $\omega$, the following equation is established:

$$\omega = \beta\phi_o/\{2(1+\beta)f\}$$

From the equations (45) and (51), therefore, the following equation is obtained:

$$\omega \simeq \sqrt{2D_f/(3f)} \simeq 1/\sqrt{3N_o} \quad (52)$$

Since the effective field $\phi_I$ is the following:

$$\phi_I \simeq 2\omega L_o,$$

therefore, if $L_o$ in the equation (45) is substituted into this equation, the following equation is obtained:

$$\phi_I \simeq 2\sqrt{N_o/3} \cdot \{(\lambda \cdot \beta)/NA_o^2\} \quad (53)$$

Figure 13:
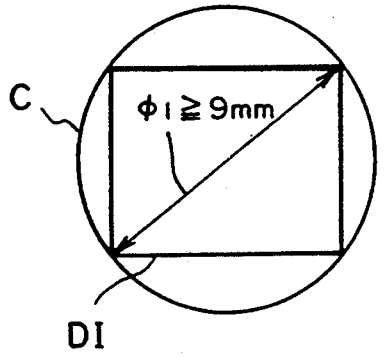
FIG. 13 is a plan view which shows the relation between the diagonal length of an imaging element and the effective region of the image formed.

As shown in the plan view of FIG. 13, it is necessary that the effective image size is greater than the diagonal length of the imaging element 15. Since the effective diagonal length of the imaging element is about 9 mm, as described below, $N_o$ may be determined so that $\phi_I \geqq 9$ mm on the basis of the equation (53). In FIG. 13, DI denotes the picture profile in the NTSC system, and C denotes the circumscribed circle thereof.

(6) Design Example of Zone Plate

In the above-described investigation, the condition No $\leqq 200$, which is determined from the viewpoint of coordination of the irradiation spectral width and the chromatic aberration described in (4), is incompatible with the condition, which is determined by the equation (53) assuming that $\phi_I \geqq 9$ mm in practical use from the viewpoint of the effective field of the zone plate described in (5). It is therefore necessary to design in serious consideration of one of the viewpoints described in (4) and (5) to form a compromise between both viewpoints.

Tables 1, 2 and 3 show the specifications of the image-forming X-ray microscopic apparatus which is designed on the basis of the above viewpoints in accordance with the present invention. Table 1 shows the specifications of an example which is designed in serious consideration of the coordination of the irradiation spectral width and the chromatic aberration described above in (4). Although this example has little chromatic aberration, the example significantly produces flare and a narrow effective visual field, which are caused by the zone plate having a small diameter, in accordance with the equation (37). The example shown in Table 2 is designed in serious consideration of the effective field of the zone plate described above in (5). In this case, although the effective field is wide, the chromatic aberration is large. Table 3 shows an example designed in serious consideration of flare. In this example, flare is little, and the effective field is wide. However, since the chromatic aberration is extremely large, it is necessary to further monochromatize X-rays.

During actual design, since the degree of freedom for design includes only one of the annular zone number $N_o$ of the zone plate and the object-image distance $L_o$, it is necessary to think one of the chromatic aberration, the effective field and flare important. Although it is therefore necessary to design in correspondence with the purpose of use, it it thought that the example shown in Table 2 is generally practical.

In any one of the embodiments below, the magnification of the zone plate as an object is trivariant, and the focal surface is not changed even when the magnification is changed (parfocal). Since $\beta >> 1$, the focal distance f of the first diffracted light is substantially the same as the working distance. $r_I$ denotes the minimum radius of the annular zones. The flare coefficient $\eta_f$ is a value obtained when $T_z=1$, $\chi=\pi$ or when an illumination method for cutting off zero-order diffracted light is employed, and $\phi_o$ is the real field.

TABLE 1

Object-image distance $L_o$ = 64 mm
Zone plate radius $r_N$ = 8 μm

| Magnification $\beta$ | Focal distance f mm | Annular zone number $N_o$ | Minimum radius $r_I$ mm | Effective field $\phi_I$ mm | Flare coefficient $\eta_f$ |
|---|---|---|---|---|---|
| 100 | 0.628 | 40 | 1.25 | 11.7 | 0.605 |
| 200 | 0.317 | 80 | 0.89 | 8.26 | 0.409 |
| 500 | 0.128 | 200 | 0.59 | 5.23 | 0.152 |

TABLE 2

Object-image distance $L_o$ = 160 mm
Zone plate radius $r_N$ = 20 μm

| Magnification $\beta$ | Focal distance f mm | Annular zone number $N_o$ | Minimum radius $r_I$ mm | Effective field $\phi_I$ mm | Flare coefficient $\eta_f$ |
|---|---|---|---|---|---|
| 100 | 1.578 | 100 | 1.98 | 18.5 | 0.334 |
| 200 | 0.792 | 200 | 1.41 | 13.1 | 0.152 |
| 500 | 0.319 | 500 | 0.89 | 8.26 | 0.039 |

TABLE 3

Object-image distance $L_o$ = 400 mm
Zone plate radius $r_N$ = 50 μm

| Magnification $\beta$ | Focal distance f mm | Annular zone number $N_o$ | Minimum radius $r_I$ mm | Effective field $\phi_I$ mm | Flare coefficient $\eta_f$ |
|---|---|---|---|---|---|
| 100 | 3.92 | 250 | 3.13 | 29.5 | 0.113 |
| 200 | 1.98 | 500 | 2.22 | 20.8 | 0.039 |
| 500 | 0.797 | 1250 | 1.41 | 12.7 | 0.008 |

The above-described numerical examples have the common specifications shown below in Table 4.

TABLE 4

| Magnification $\beta$ | Numerical aperture $NA_o$ | Resolving power δ nm | Focal depth $D_f$ nm | Real field $\phi_o$ mm |
|---|---|---|---|---|
| 100 | 0.0125 | 100 | 8000 | 90 |
| 200 | 0.025 | 50 | 2000 | 45 |
| 500 | 0.0625 | 20 | 300 | 18 |

(The resolving power equals to the minimum zone width since $\beta >> 1$)

(xiv) Other Arrangements of the Condenser System

As mentioned above, it is also effective to arrange the condenser system of the present invention by using a combination of a concave reflecting mirror and a diffraction grating in place of the rotary elliptical multilayer film mirror. An example of this arrangement will be described below.

One of the simplest arrangements based on a combination of a concave reflecting mirror and a diffraction grating is such that a toroidal concave diffraction grating is used and is integrally combined with a concave reflecting mirror. In this case, the construction is generally the same as that shown in FIG. 1. That is, the same construction can be used except that the rotary elliptical surface multilayer film mirror 9 shown in FIG. 1 is used as a toroidal concave diffraction grating. In this arrangement, X-rays from the x-ray thin film target 5 caused by the pulse laser 1 are condensed by the toroidal concave diffraction grating 9, and a sample 13 is disposed at the focal point of this condensing. The X-rays are monochromatized by the diffraction grating 9. The sample is thereby irradiated with the one-pulse X-rays excited and emitted by the pulse laser, and photon count imaging is effected by the two-dimensional X-ray imaging element 15.

If the radius of curvature of the toroidal concave diffraction grating is Rv, the angle of incidence from the X-ray source upon the center of the diffraction grating (main incidence angle) is α, the distance therebetween is r, the angle of diffraction of X-rays from the center of the diffraction grating to the the sample is b, and the distance therebetween is r', then it is desirable that the following equations (17) and (18) are satisfied.

$$\frac{\cos^2\alpha}{r} - \frac{\cos\alpha}{Rh} + \frac{\cos^2\beta}{r'} - \frac{\cos\beta}{Rh} = 0 \quad (17)$$

$$\frac{1}{r} - \frac{\cos\alpha}{Rv} + \frac{1}{r'} - \frac{\cos\beta}{Rv} = 0 \quad (18)$$

If the X-ray source and the sample are on the Rowland circle of the diffraction grating, high-order spherical aberrations can be corrected. It is therefore advantageous to set the X-ray source and the sample in this manner. In this case, r and r' are $$r = Rh \cos \alpha,\ r' = Rh \cos \beta. \quad (19)$$

The radius of curvature can be calculated from $$Rv/Rh = \cos \alpha \cdot \cos \beta. \quad (20)$$

Examples of the values of this system specified when the wavelength of X-rays is 3.7 nm and $\alpha$ is 86° are shown below.

| Diffraction grating | |
|---|---|
| Slit distance d: | 0.5 μm |
| Main curvature radius Rh: | 1.5 m |
| Sub curvature radius Rv: | 14.6 mm |
| Effective size: | 100 × 20 mm |
| Wavelength dispersion: | 0.33 Å/100 μm |

The disposition of the X-ray source and the sample $$r = 104.6 \text{ mm},\ \alpha = 86°$$

$$r' = 209.9 \text{ mm},\ \beta = 81.96°$$

It is known that the efficiency of the diffraction grating is about 5% in this wavelength range. In this example, NA changes with respect to meridional and sagittal light beams but is 0.04 on average; the numerical aperture also satisfies the condition. If the size of the X-ray source is 45 μm, the field of view on the sample surface is 45×90 μm and the wavelength width is 0.15 Å, so that $\lambda/\Delta\lambda = 240$.

A rotary elliptical surface diffraction grating may be used instead of the toroidal surface diffraction grating. If the diffraction grating slit distance is the same as the above-described embodiment, i.e., 0.5 μm, suitable spectral illumination light aberration-corrected by the same disposition of the X-ray source, the diffraction grating and the sample as that described above can be obtained by using a diffraction grating in which the lengths of the three axes (ra, rb, rc) of the rotary elliptical surface are $$ra = 1.5 \text{ m},\ rb = 1.5 \text{ m}, \text{ and } rc = 148 \text{ mm}.$$

The surface of the diffraction grating is coated with a material such as gold, platinum or aluminum oxide having a high reflectivity. Aluminum oxide is suitable in a range of wavelengths longer than 3 nm.

The reflectivity of the diffraction grating changes with the incidence angle, and the diffraction efficiency also changes with it. To maximize the quantity of effective light, an incidence angle is selected at which the product of NA (numerical aperture) and the reflectivity is maximized. If the width of the diffraction grating is constant, NA on the plane containing the X-ray source, the center of the diffraction grating and the sample is proportional to cos $\alpha$. $\eta c(\%) \cdot \cos \alpha$ is thereby obtained as shown in FIG. 5. The incidence angle may be set to about 86° to maximize the quality of light.

More specifically, it is preferable to set the angle $\alpha$ of main incidence of X-rays upon the diffraction grating used as a spectroscopic condenser in the range of $$84° \leqq \alpha \leqq 88°.$$

If the angle $\alpha$ is smaller than the lower limit of this range, the reflectivity of the diffraction grating is reduced so that the loss of the quantity of light is excessively large. If the upper limit is exceeded, the aperture of the diffraction grating and the reflecting mirror is excessively large and restrictions on the optical disposition are increased.

From the viewpoint of the above, a toroidal surface diffraction grating which enables suitable aberration correction by one-time reflection and, hence, efficient spectral diffraction and condensing is suitable as a condenser. It is also very effective with respect to cooling of the element, because it is possible to cool a diffraction grating from the reverse surface The provision of a multilayer film on a diffraction grating is also effective in improving the reflectivity of the diffraction grating.

Figure 14:
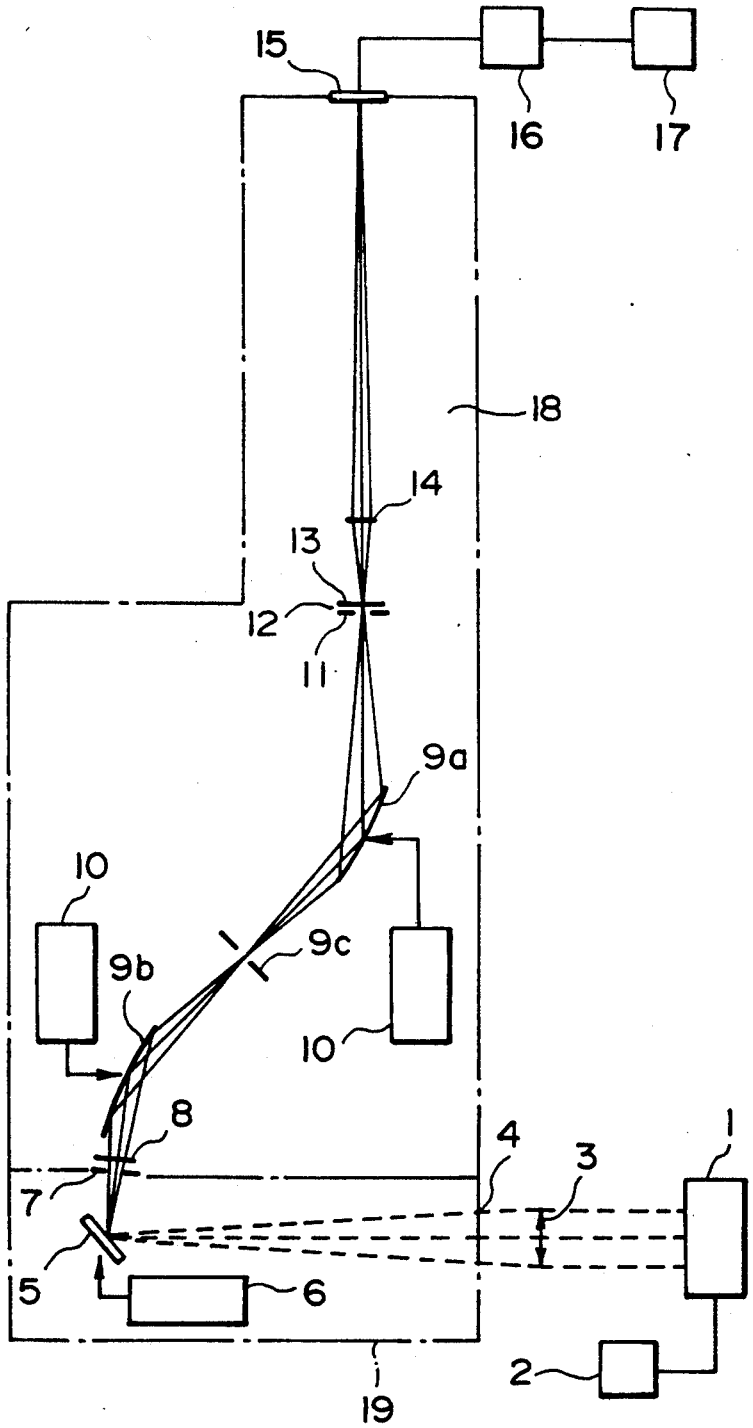
FIG. 14 is a schematic drawing of the structure of another embodiment using a concave surface diffraction grating in a condenser system.

FIG. 14 schematically shows the construction of the second embodiment of the present invention in which a diffraction grating is used for the condenser system. In this embodiment, a spectroscopic condenser is constituted of a concave diffraction grating 9a and a toroidal surface reflecting mirror 9b in place of the toroidal surface diffraction grating 9 used alone as shown in FIG. 1. Light from a target 5 which is an X-ray source is reflected by the toroidal surface reflecting mirror 9b, and sagittal beam of it is condensed in the vicinity of an intermediate aperture 9c of a shielding plate and is then made incident upon the concave diffraction grating 9a. X-rays thereby separated are condensed on a sample 13 in sample container 12. On the other hand, a meridional light beam orthogonal to this light beam is reflected by the toroidal surface reflecting mirror 9b and travels via the concave diffraction grating 9a to be incident upon the sample 13. In other respects, the construction is the same as that of the first embodiment shown in FIG. 1. In FIG. 14, the components having the same functions as those of the arrangement shown in FIG. 1 are indicated by the same reference characters.

By such a combination of a toroidal surface reflecting mirror and a concave diffraction grating, an image from the X-ray source can be formed on the sample surface. There are several possible variations of such a combination. However, one in which the intermediate aperture 9c and the sample are disposed so as to be located on the Rowland circle of the concave diffraction grating 9a is good in terms of aberration correction. Examples of the values of this system specified therefor are shown below.

| | |
|---|---|
| Concave diffraction grating | |
| Slit distance d: | 0.5 μm |
| Curvature radius R: | 1.5 m |
| Toroidal surface reflecting mirror | |
| Main curvature radius Rh: | 2.5 m |
| Sub curvature radius Rv: | 18.0 mm |
| The distance between the X-ray source and the toroidal surface reflecting mirror: | 174.4 mm |
| The angle of incidence of X-rays upon the toroidal surface reflecting mirror: | 86° |
| The distance between the toroidal surface reflecting mirror and the intermediate aperture: | 174.4 mm |
| The distance r between the intermediate aperture and the concave diffraction grating: | 104.6 mm |
| The angle $\alpha$ of incidence upon the concave diffraction grating: | 86° |
| The distance r' between the concave diffraction grating and the sample: | 209.9 mm |
| The diffraction angle $\beta$: | 81.96° |

The number of reflecting surfaces of this embodiment is greater than that in the first embodiment by one, and the quantity of effective light is therefore reduced to ½ to ⅓. However, it is possible to provide an X-ray source strong enough to cancel this reduction. Since the toroidal reflection mirror may effect condensing alone, the allowance of the contour accuracy is increased in comparison with the first embodiment and the facility with which the reflecting mirror is worked is thereby improved. Also, the diffraction grating which must be formed with high accuracy can be provided as a concave grating, it can therefore be easily worked.

Ordinarily, the intermediate aperture corresponds to the incidence slits of the spectroscopic section and is necessary for determining the spectrum width. In this embodiment, however, the light beam size at the position of the intermediate aperture is determined by the size of the X-ray source. The intermediate aperture may therefore be removed but it is effective in previously adjusting the spectroscopic condenser or removing scattered light components.

Figure 15:
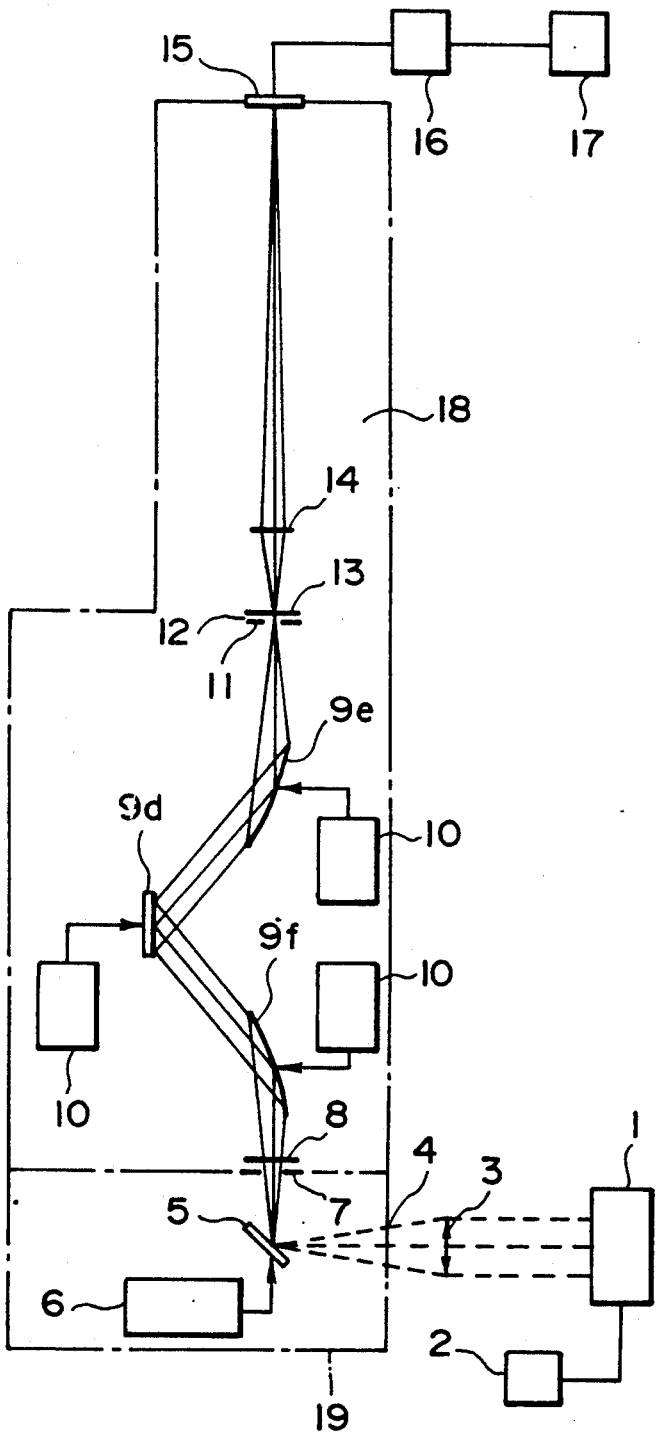
FIG. 15 is a schematic drawing of the structure of another embodiment using a flat surface diffraction grating in a condenser system.

FIG. 15 schematically shows the third embodiment of the present invention in which a diffraction grating is used for the condenser system. In this embodiment, the spectroscopic condenser is constituted of a flat plane diffraction grating 9*d* and two out-of-axis paraboloidal mirrors 9*e* and 9*f*. A target 5 which is an X-ray source is placed at the focal point of the first paraboloidal mirror 9*f*. X-rays from the target 5 are reflected by the first paraboloidal mirror 9*f* and thereby travel as a parallel light beam to be incident upon the flat plane diffraction grating 9*d*. The diffracted light from the plane diffraction grating 9*d* is reflected by the second paraboloidal mirror 9*e* so that separated X-rays are condensed on a sample 13 placed at the focal point of this mirror. In other respects, the construction is the same as that of the first embodiment shown in FIG. 1. In FIG. 15, the components having the same functions as those of the arrangement shown in FIG. 1 are indicated by the same reference characters.

In this embodiment, the magnification of the spectroscopic condenser is changed through a wide range by selecting the combination of the focal distances of the two paraboloidal mirrors 9*e* and 9*f*. Examples of the values of this system specified when the magnification is 1 are shown below.

| | |
|---|---|
| Assuming that the paraboloid is expressed by a general formula: | $y^2 + z^2 = 4$ px, $p = 0.1827$ |
| The distance between the X-ray source and the first paraboloidal mirror: | 150.0 mm |
| The angle of incidence upon the first paraboloidal mirror: | 86.0° |
| The distance between the first paraboloidal mirror and the diffraction grating: | 200.0 mm |
| The flat plane diffraction grating slit distance: | 0.5 μm |
| The Angle of incidence upon the flat plane grating: | 86.0° |
| The diffraction angle: | 81.96° |
| The distance between the diffraction grating and the second paraboloidal mirror: | 200 mm |
| The angle of incidence upon the second paraboloidal mirror: | 86° |
| The distance between the second paraboloidal mirror and the sample: | 150 mm |

With respect to these values, the diffraction grating has a wavelength dispersion in the plane of FIG. 5. That is, the slits of the diffraction grating are perpendicular to the plane of projection of FIG. 15.

It is also possible to arrange the system by turning the disposition of the diffraction grating by 90° so that the slits of the diffraction grating are in the plane of the diagram. In this case, the definition of the angles of incidence and diffraction at the flat plane grating is complicated. However, the diffraction grating can be slightly rotated on an axis contained in the plane of the diagram so that the main light beam travels as if it is reflected by normal reflection in the plane of the diagram by the diffraction grating. If the angle of this incidence in the plane of the diagram is 86°, a spectroscopic condenser can be made while other values are the same as those of the third embodiment listed above. In this spectroscopic condenser, the use of the diffraction grating is different from the use in the above embodiment. However, it is known that by this use the diffraction efficiency is made closer to the reflectivity. In this case, a diffraction efficiency higher than that in the first to third embodiments, which is 8%, can be realized and the reduction in the quantity of light due to the increase in the number of reflecting surfaces can be sufficiently compensated.

(xv) Combination of X-ray Microscope and Optical Microscope

If the X-ray microscope of the present invention is used in combination with an optical microscope, a narrow field of view of the X-ray microscope can easily be confirmed and optical adjustment of the X-ray microscope can be performed in a simple manner. In combining microscopes of these kinds, it is effective to use a co-axial construction of an illumination optical system and an objective optical system of an optical microscope for confirming the field of view for observation while constructing the overall system based on the image formation type X-ray microscope described first with reference to FIG. 1. That is, a reflection area for reflecting illumination light for the optical microscope is provided around a concave aspherical surface multilayer film mirror condenser provided as a light condensing means in the X-ray illumination system to enable the concave aspherical surface mirror for X-rays to be also used as a condenser for the optical microscope, and an imaging optical path is formed in a through aperture of an objective lens of the optical microscope on the optical axis thereof by a zone plate provided as an X-ray objective.

In this arrangement, X-rays can be reflected and condensed by a central portion of the concave aspherical reflecting mirror in the illumination system while the illumination light for the optical microscope is reflected by the central portion and the peripheral portion; the concave aspherical reflecting mirror can be used for both the illumination systems for the X-ray microscope and the optical microscope. It is possible to efficiently supply illumination light for the optical microscope requiring a numerical aperture (NA) greater than the illumination numerical aperture of the X-ray microscope. Thus, the overall system has a simple construction and the optical axis adjustment of the X-ray microscope can be performed easily and precisely with the optical microscope.

Figure 16:
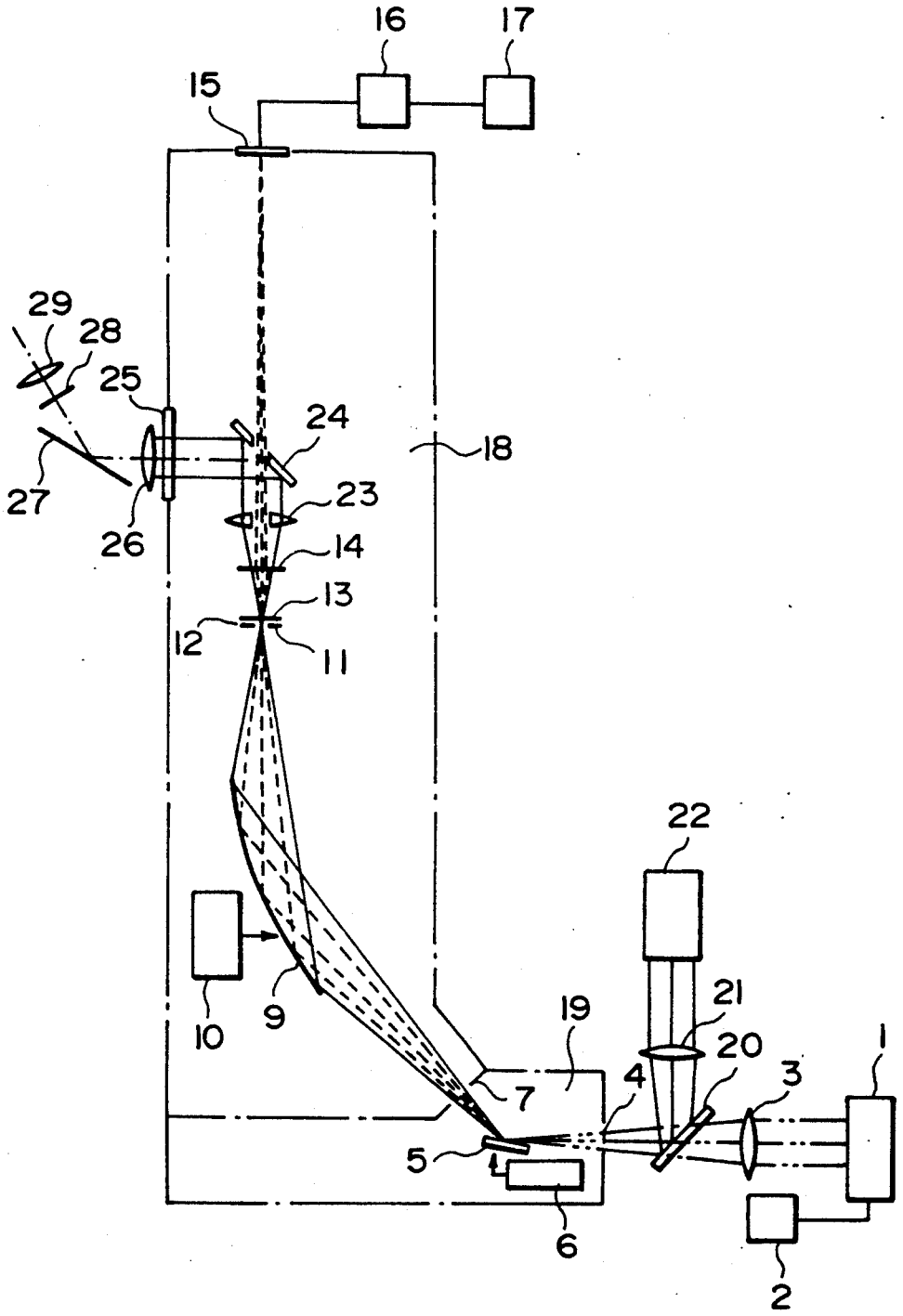
FIG. 16 is a schematic drawing of the structure of an embodiment which is a combination of an optical microscope and the X-ray microscope according to the invention.

FIG. 16 is a diagram schematically showing the construction of an image formation type soft X-ray microscope designed in accordance with this conception. Laser light generated by a pulse laser 1 is condensed on a disk- or tape-like thin film target 5 through a vacuum maintaining window 4 by a condenser lens 3 so that X-rays having an intensity and a wavelength required are generated. The light emission of the pulse laser 1 is controlled by a pulse control unit 2 with a desired pulse separation (0.01 to several Hz). X-rays from the X-ray thin film target 5 are condensed on a test piece 13 in a test piece container 12 by a rotary elliptical multilayer film reflecting mirror 9. A test piece image is enlarged and formed on a two-dimensional X-ray imaging element 15 by using a zone plate (ZP) 14 for an imaging optical system. It is effective to use a solid-state image sensor, e.g., a back irradiation-type FT-CCD as the two-dimensional X-ray imaging element 15.

As illustrated, in this arrangement, the X-ray thin film target 5, which is excited by the pulse laser, is disposed at the first focal point of the rotary elliptical multilayer film reflecting mirror 9, and the test piece 13 is disposed at the second focal point thereof. X-rays are monochromatized by the multilayer film reflecting mirror 9. The test piece is irradiated with one-pulse X-rays emitted by excitation by the pulse laser, and photon counting imaging is performed by the two-dimensional X-ray imaging element 15.

To observe the test piece 13 while horizontally maintaining the same, the X-rays for irradiation and observation are made to travel in a vertical direction, and the laser beam for excitation of X-rays is made to travel in a horizontal direction. Specifically, the angle between the target 5 and the excitation laser beam is set to about 35°, and the angle of incidence of X-rays upon the rotary elliptical multilayer film reflecting mirror 9 is set to about 65°. A means 6 for interchanging the X-ray thin film target 5 and removing scattered waste materials and the like and a diaphragm 7 are arranged to make X-rays travel in a predetermined direction. At the rear of the rotary elliptical multilayer film reflecting mirror 9 serving as a condenser, a water cooling unit 10 is provided to prevent temperature rising and deterioration of the mirror caused by absorption of X-rays.

A field diaphragm 11 is provided in front of and close to the test piece container 12. It is changed to select an appropriate aperture size according to the observation magnification. However, it may be changed to select a different aperture as desired for the purpose of preventing flare or improving the contrast, while the same magnification is set. Image information output from the two-dimensional X-ray imaging element 15 is processed by an image processing unit 16, and is then output to an image output unit 17 such as a display, a printer or the like.

These components, the components from the rotary elliptical multilayer film concave reflecting mirror 9 serving as a condenser to the light-receiving surface of the two-dimensional X-ray imaging element 15, are accommodated in a vacuum container 18 to be maintained under vacuum. The pressure in the vacuum container 18 is kept at about $10^{-2}$ Pa at which the X-ray absorption effect is negligible. Since the removing means 6 or the like must be provided around the X-ray thin film target 5 to cope with the generation of scattered substances therearound, it is necessary to isolate the X-ray source section by placing the same in another vacuum container 19.

Figure 17:
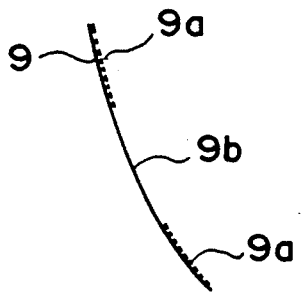
FIG. 17 is a sectional view showing a structure of a concave reflection mirror.
Figure 18:
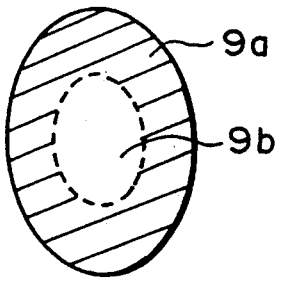
FIG. 18 is a plan view showing the structure of the concave reflecting mirror.

Visible light from an illumination light source 22 for the optical microscope is condensed on the X-ray target 5 through a condenser lens 21 and a dichroic mirror 20 provided as a light separating device. The point to which the light is thereby condensed coincides with the point to which laser light from the pulse laser 1 is condensed. Light reflected by the target 5 is condensed on the test piece 13 by the rotary elliptical multilayer film concave reflecting mirror 9, as in the case of X-rays from the target 5. As shown in FIG. 17 in section and in FIG. 18 in plan, a reflection area **9*a* used exclusively for visible light is formed on a peripheral portion of the rotary elliptical multilayer film concave reflecting mirror 9, while a multilayer film reflection area 9*b* used to reflect X-rays is formed on a central portion of this mirror. The visible light reflection area may be provided by aluminum deposition. The X-ray reflecting multilayer film is capable of reflecting visible light at a substantially high rate, the arrangement may alternatively be such that the whole surface of the reflecting mirror 9 is formed as an X-ray multilayer film mirror, a central portion thereof is used for an area for reflecting X-rays, and the whole surface is used as a visible light reflection area. In either case, X-rays are reflected by the central portion of the concave reflecting mirror 9 while visible light is reflected by the central and peripheral portions It is thereby possible to sufficiently provide illumination with a large NA (aperture value) necessary for an objective lens 23 along with illumination with a comparatively small NA of the zone plate 14** serving as an X-ray objective while maintaining the coaxial state of these optical elements.

Figure 19:
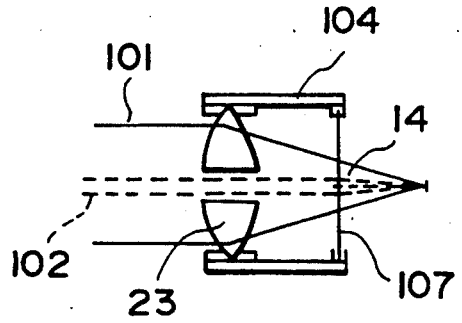
FIG. 19 is a sectional view showing a structure of an objective optical system.

The zone plate 14 serving as an X-ray objective and the objective lens 23 of the optical microscope are arranged coaxially with each other, and the zone plate 14 optical path of the X-ray microscope is formed in an aperture formed through the objective 23 of the optical microscope along the optical axis thereof. Details of the zone plate 14 and the objective 23 of the optical microscope are illustrated in FIGS. 19 and 20.

Figure 20:
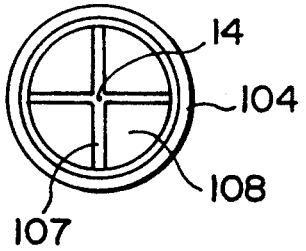
FIG. 20 is a plan view showing the structure of the objective optical system.

The body tube of the objective 23 of the optical microscope has a portion 104 projecting on the test piece side, and the zone plate 14 is supported in this portion by a crisscross support member 107 such as that shown in the plan view of FIG. 20. As shown in FIG. 19, the X-ray imaging optical path of the zone plate 14 is formed in the aperture formed through the optical microscope objective 23 along the optical axis thereof. Although the optical path of the optical microscope is slightly obstructed by the support member 107 as shown in FIG. 20, a sufficient quantity of observation light can be obtained through openings 108. Strictly, it is necessary to make a beam of light 102 from the zone plate 14 slightly convergent in order that the image of the test piece is enlarged and imaged on the two-dimensional X-ray imaging element 15 by the zone plate 14. The optical focal point of the zone plate 14 is slightly deviated to the emergent light side from the optical focal point of the objective 23. Therefore a beam of light 101 from the objective 23 is formed generally parallel, as shown in FIG. 19. Thus, the zone plate 14 and the objective 23 is integrally arranged so that the object point of the image formed by the zone plate 14 and the object point of the image formed by the objective 23 coincide with each other. The objective 23 may therefore be focused with respect to the test piece by being moved on the axis to automatically complete the focusing of the X-ray microscope with the zone plate 14. Generally, the numerical aperture of the zone plate 14 is very small, and it is therefore difficult to focus the X-ray microscope. However, this integral arrangement with the objective 23 of the optical microscope makes it easy to focus the X-ray microscope.

As shown in FIG. 16, the beam of parallel light from the optical microscope objective 23 is reflected by a reflecting mirror 24 with an aperture obliquely disposed, and is led to out of the vacuum container 18 through an window glass 2 to form a spatial image 28 via an optical path flexing mirror 27. The spatial image 28 can be observed through an ocular lens 29 at a predetermined magnification.

In this embodiment, the X-ray image and the visible light image are separated by the oblique reflecting mirror 24 having an aperture. However, if a detector having a characteristic such as to be sensitive to visible light well as to X-rays, e.g., a CCD, is used as the two-dimensional X-ray imaging element 15, it is possible to construct the observation systems of the X-ray microscope and the optical microscope completely coaxially. Preferably, for the rotary elliptical multilayer film concave reflecting mirror 9, a very small absorptive member, such as a very small piece of aluminum, is provided at a central position (on the optical axis) to prevent occurrence of noise in the imaging element 15 due to incidence of X-rays upon the optical axis of the zone plate 14.

(xvi) OTHERS

(1) Magnification Change

In order to minimize damage to the sample, the X-rays must be applied only to a necessary region. In addition, in order to effectively utilize the X-ray source, it is necessary to combine a multilayer film mirror condenser, which is exclusively used for illumination within a necessary region and with a necessary numeral aperture for each resolving power and magnification of the objective optical system. When the magnification of the objective optical system is changed to each of the magnifications shown in the tables, it is necessary to change the rotary elliptical multilayer film mirror serving as a condenser to an appropriate one in correspondence with the objective optical system changed.

Figure 21:
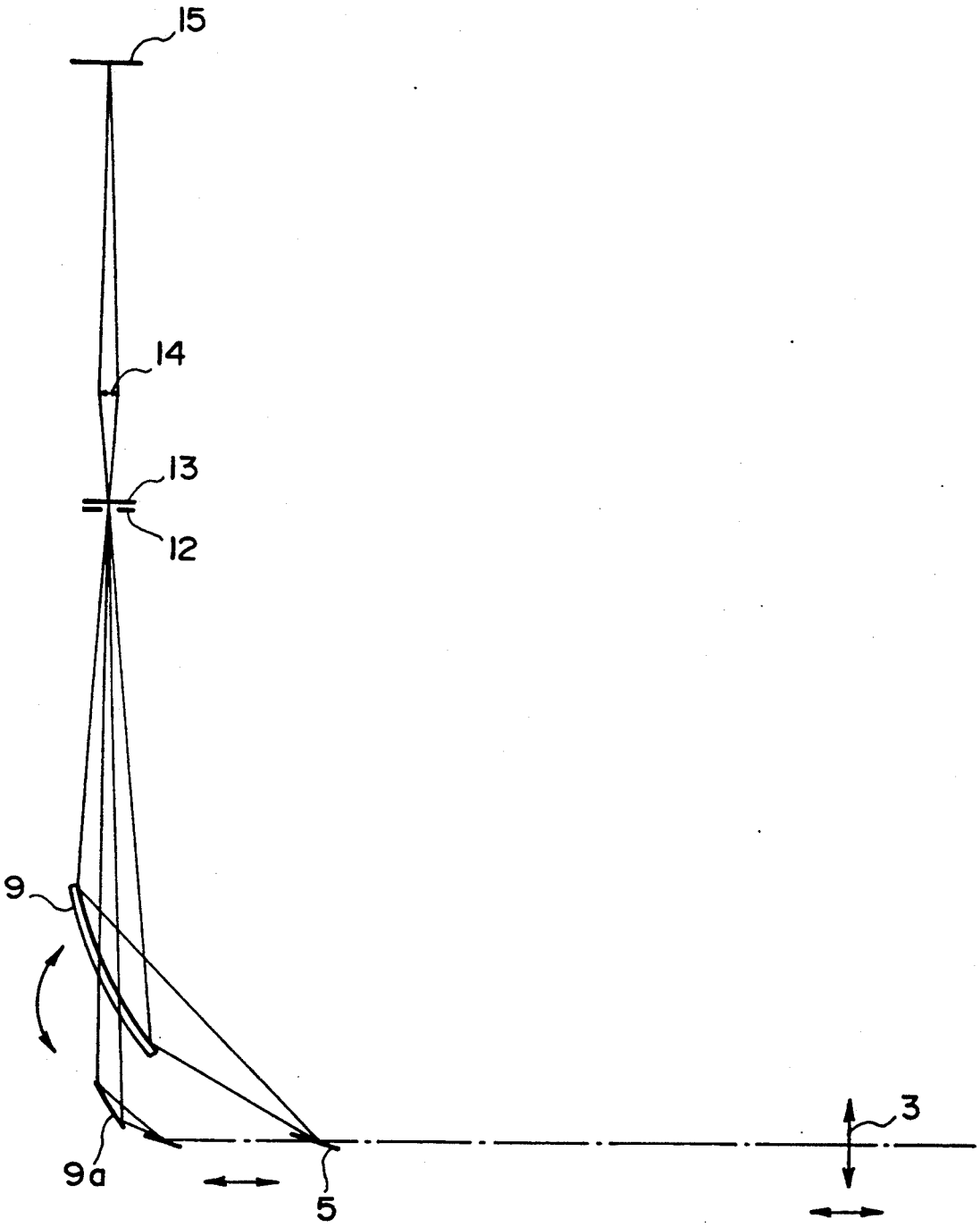
FIG. 21 is a schematic drawing of a configuration which shows a state where a rotary elliptical multilayer film mirror serving as a condenser is changed to another mirror.

As shown in FIG. 21, in order to the rotary elliptical mirror, a rotary elliptical multilayer film mirror 9*a* having magnification, which is different from that of the rotary elliptical multilayer film mirror 9, is disposed at a different position in the vertical direction, and the laser condensing lens 3 and the target 5 are integrally moved in the horizontal direction. At this time, as a matter of course, the target 5 and the sample 13 are positioned at the first focal point and the second focal point, respectively, of the rotary elliptical multilayer film mirror.

(2) Window Material of Sample Container

It is necessary to use as the window material of the container for receiving the sample a material such as $Si_3N_4$ film or the like, which has high X-ray transmittance. In this case, it is preferable that the thickness of the sample container is 50 nm, and the window diameter is about 100 μm in view of the relation to the effective visual field. A container having the structure disclosed in Japanese Patent Appln. Laid-Open No. 63-298200 by the same applicant as this application may be used.

(3) Two-dimensional X-ray Imaging Element

In the two-dimensional imaging element, which is capable of counting photons, it is preferable that the wavelength region with detection sensitivity is 2.3 to 4.4 nm, the quantum efficiency and aperture efficiency are substantially 100%, the pixel dimension is 10 mm, the pixel number in accordance with the TSC system is $700 \times 525 = 367500$, the diagonal length is 9 mm and the image number per second is 30. The system for such an element is, for example, back irradiation FT-CCD or the like.

(4) Monitor Observation by Optical Microscope

Figure 22:
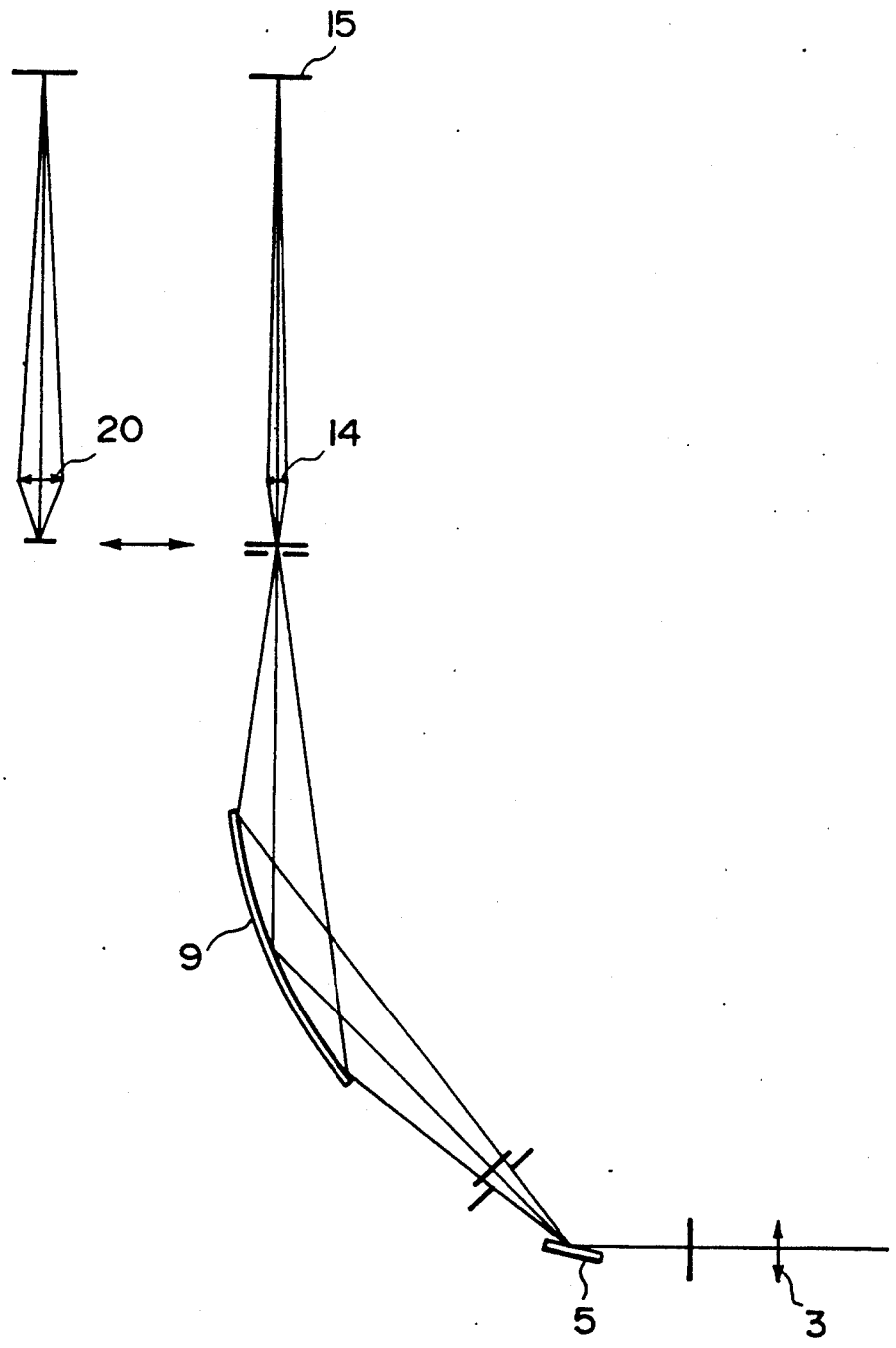
FIG. 22 is a drawing which shows the change in observation state by exchange of an optical microscope for an X-ray microscope.

Since constant observation of a sample by using an X-ray microscope accelerates damage to the sample, as shown in FIG. 22, it is effective that the sample is usually observed by an optical microscope 20, and, if required, the sample is transferred onto an X-ray microscope so that the biological cells only in a necessary portion is observed by the X-ray microscope. In this case, the system of the optical microscope is preferably designed so that it is possible to perform microscopic methods for a phase difference, differential interference, polarization, fluorescent light, a dark field and the like.

In the above-described image-forming soft X-ray microscope in accordance with the present invention, X-rays are monochromatized by the multilayer film mirror, the X-rays of one pulse emitted from the pulse X-ray source are condensed on the sample by the elliptical multilayer film reflecting mirror serving as a condenser, an enlarged image is formed by the phase zone plate serving as an objective optical system, and photon counting imaging is photoelectrically made by the two-dimensional X-ray imaging element. It is therefore possible to achieve high efficiency and high resolving power. This permits the minimization of damage to a living sample and dynamical observation of the living sample with high resolving power of about 20 nm, without breaking it. In addition, although a sample is observed by a general electron microscope in a state where the sample is fixed after it has been instantaneously frozen, sliced and stained. However, the present invention permits dynamical observation of living cells, without fixing and breaking the cells. Although dynamical observation can be made by an optical microscope without fixing and breaking a sample, the resolving power is 200 nm at most. However, the X-ray microscope of the present invention permits observation with extremely high resolving power which reaches 20 nm.

What is claimed is:

1. An image formation-type soft X-ray microscopic apparatus comprising:

a pulse X-ray source for applying X-rays;

a single concave aspherical multilayer film condenser for reflecting the X-rays emitted from said pulse X-ray source so as to condense said X-rays on a sample;

a two-dimensional X-ray imaging sensor;

a phase zone plate objective optical system for forming an image of said sample on said two-dimensional X-ray imaging sensor by using said X-rays;

image processing means connected to said two-dimensional X-ray imaging sensor; and output means connected to said image processing means for the purpose of outputting an image of said sample.

2. An image formation-type of soft X-ray microscopic apparatus according to claim 1, wherein said concave aspherical multilayer film condenser is a rotary elliptical multilayer film reflecting mirror, said pulse X-ray source being disposed as the first focal point of said rotary elliptical multilayer film reflecting mirror, and said sample being disposed at the second focal point thereof.

3. An image formation type of soft X-ray microscopic apparatus according to claim 2, wherein said pulse X-ray source is a pulse laser excitation plasma X-ray source which condensing pulse lasers on a target to generate X-rays, said X-rays are monochromatized by said rotary elliptical multilayer film reflecting mirror, and photon counting imaging is performed by using the X-rays of one pulse emitted by excitation by said pulse laser.

4. An image formation-type of soft X-ray microscopic apparatus according to claim 3, wherein said pulse laser excitation X-ray source generates X-rays with intensity in terms of the maximum number $n_{max}$ of the photons per pixel incident on said two-dimensional X-ray imaging sensor, which is within the following range:

$$25 \leqq n_{max} < \lambda/\Delta\lambda$$

wherein $\lambda$: wavelength of X-ray $\Delta\lambda$: spectral width.

5. An image formation-type of soft X-ray microscopic apparatus according to claim 4, wherein said pulse laser excitation plasma X-ray source generates pulse X-rays which permits said two-dimensional X-ray imaging element to image by using one pulse having a pulse width of 1 $\mu$s or less, the number of period Nc of the layer structure of said rotary elliptical multilayer film reflecting mirror is 50 to 400, and the X-rays emitted from said pulse laser X-ray source are monochromatized by said rotary elliptical multilayer film reflecting mirror so that $\lambda/\Delta\lambda = 50$ to 400 and are condensed on a sample.

6. An image formation-type of soft X-ray microscopic apparatus according to claim 5, wherein the wavelength region of the X-rays applied to said sample from said rotary elliptical multilayer film reflecting mirror is 2.3 to 4.4 nm.

7. An image formation type soft X-ray microscopic apparatus comprising:

a pulse X-ray source capable of emitting X-rays;

irradiation means having a concave reflecting surface for reflecting X-rays emitted from said pulse X-ray source so that the X-rays are condensed on a test piece;

a zone plate objective for forming an image of the test piece;

a two-dimensional X-ray imaging element for receiving the test piece image formed by said zone plate objective;

image processing means connected to said two-dimensional X-ray imaging element; and output means connected to said image processing means to output the image of the test piece.

8. An image formation type soft X-ray microscopic apparatus according to claim 7, wherein said concave reflecting surface is an aspherical surface multilayer film mirror which separates X-rays in a predetermined wavelength range from the X-rays emitted from said pulse X-ray source and makes the separated X-rays travel to the test piece, and said zone plate objective is a phase zone plate objective.

9. An image formation type soft X-ray microscopic apparatus according to claim 7, wherein said irradiation means includes a diffraction grating which separates X-rays in a predetermined wavelength range from the X-rays emitted from said pulse X-ray source and condenses the X-rays in the predetermined wavelength range to the test piece in cooperation with said concave reflecting surface.

10. An image formation type soft X-ray microscopic apparatus according to claim 9, wherein said diffraction grating of said irradiation means comprises a reflection type diffraction grating formed on said concave reflecting surface to form a toroidal concave diffraction grating.

11. An image formation type soft X-ray microscopic apparatus according to claim 10, wherein said irradiation means further includes a light shielding plate disposed at a point to which light is condensed by said toroidal concave diffraction grating, said light shielding plate having an aperture, and a second concave reflecting mirror, X-rays passed through the aperture of said shielding plate being condensed on the test piece by said second concave reflecting mirror.

12. An image formation type soft X-ray microscopic apparatus according to claim 9, wherein said irradiation means includes two concave reflecting mirrors, and said diffraction grating is a reflection type flat-plane diffraction grating, one of said concave reflecting mirrors making X-rays from said pulse X-ray source travel to said flat-plane diffraction grating while making the same generally parallel, the other of said concave reflecting mirrors condensing, on the test piece, X-rays in the predetermined wavelength range from said flat-plane diffraction grating.

13. An image formation type soft X-ray microscopic apparatus according to claim 9, wherein the angle $\alpha$ at which X-rays from said pulse X-ray source are mainly incident upon said concave reflecting surface and said diffraction grating is within the range of $$84° \leqq \alpha \leqq 88°.$$

14. An image formation type soft X-ray microscopic apparatus according to claim 13, wherein said pulse X-ray source comprises a pulse laser excitation plasma X-ray source which condenses pulse laser light on a target to generate X-rays, and said two-dimensional X-ray imaging element effects photon counting imaging with one-pulse X-rays excited and emitted by the pulse laser light.

15. An image formation type soft X-ray microscopic apparatus according to claim 14, wherein said pulse laser excitation X-ray source has an X-ray generation intensity such that the maximum number $n_{max}$ of photons incident upon said two-dimensional X-ray imaging element and detected per pixel is $$25 \leqq n_{max}.$$

16. An image formation type soft X-ray microscopic apparatus according to claim 15, wherein said pulse laser excitation plasma X-ray source generates one-pulse X-rays having a pulse width of not more than 1 $\mu$s and having an intensity such as to enable imaging with said two-dimensional X-ray imaging element, and wherein if the wavelength of the X-rays is $\lambda$ and the spectrum width is $\Delta\lambda$, the X-rays from said pulse laser are condensed on the test piece after being monochromatized by said diffraction grating so that $\lambda/\Delta\lambda = 50$ to 500.

17. An image formation type soft X-ray microscopic apparatus according to claim 16, wherein the wavelength range of X-rays condensed on the test piece by said diffraction grating is 2.3 to 4.4 nm.

18. An image formation type soft X-ray microscopic apparatus having an optical microscope, comprising:

an X-ray source capable of emitting X-rays;

a light source for supplying illumination light for the optical microscope;

irradiation means having a multilayer concave reflecting mirror for reflecting X-rays emitted from said X-ray source so that the X-rays are condensed on a test piece, said multilayer concave reflecting mirror having a reflection area for reflecting the illumination light for the optical microscope formed at least on its peripheral portion;

a zone plate objective for forming an image of the test piece by condensing X-rays transmitted through the test piece;

a two-dimensional X-ray imaging element for detecting the test piece image formed by said zone plate objective; and an optical microscope objective having an aperture formed along its optical axis to enable formation of an optical path for the zone plate objective, said zone plate objective is disposed so that the optical axes of said zone plate objective and said optical microscope objective coincide with each other in said aperture formed through said optical microscope objective.

19. An image formation type soft X-ray microscopic apparatus according to claim 18, wherein said optical microscope objective has a body tube member projecting to the test piece side, and said zone plate is mounted in said body tube member.

20. An image formation type soft X-ray microscopic apparatus according to claim 18, wherein said X-ray source includes a laser light source and a laser irradiation optical system for leading light from said laser light to the X-ray target, illumination light for said optical microscope being supplied through a light separating device disposed in said laser irradiation optical system.

* * * * *